US007775163B2

(12) United States Patent
Forbes et al.

(10) Patent No.: US 7,775,163 B2
(45) Date of Patent: Aug. 17, 2010

(54) RAIL ROAD CAR AND BEARING ADAPTER FITTINGS THEREFOR

(75) Inventors: James W. Forbes, Campbellville (CA); Jamal Hematian, Burlington (CA); Tomasz Bis, Ancaster (CA); William R. Davis, Beamsville (CA)

(73) Assignee: National Steel Car Limited (CA)

( * ) Notice: Subject to any disclaimer, the term of this patent is extended or adjusted under 35 U.S.C. 154(b) by 0 days.

(21) Appl. No.: 11/860,003

(22) Filed: Sep. 24, 2007

(65) Prior Publication Data

US 2008/0066641 A1 Mar. 20, 2008

Related U.S. Application Data

(63) Continuation of application No. 11/019,664, filed on Dec. 23, 2004, now abandoned.

(51) Int. Cl.
*B61F 5/26* (2006.01)

(52) U.S. Cl. ..... 105/224.1

(58) Field of Classification Search ..... 105/218.1, 105/218.2, 219, 220, 221.1, 222, 223, 224.1
See application file for complete search history.

(56) References Cited

U.S. PATENT DOCUMENTS 692,086 A 1/1902 Stephenson
895,157 A 8/1908 Bush
931,658 A 8/1909 Stephenson
1,316,553 A 9/1919 Barber
1,695,085 A 12/1928 Cardwell (Continued)

FOREIGN PATENT DOCUMENTS

CA 714822 8/1965

(Continued)

OTHER PUBLICATIONS

1937 Car and Locomotive Cyclopedia, (New York: Simmons-Boardman Publishing Corporation) pp. 892-893.

(Continued)

*Primary Examiner*—S. Joseph Morano
*Assistant Examiner*—Robert J McCarry, Jr.
(74) *Attorney, Agent, or Firm*—Hahn Loeser & Parks LLP; Michael H. Minns

(57) ABSTRACT

A rail road freight car truck, which may be a Barber S2HD truck or other kind of truck, has a truck bolster and a pair of side frames, the truck bolster being mounted transversely relative to the side frames. The sideframes are mounted on a pair of wheelsets. The bolster may be resiliently sprung and may have friction dampers. Either the friction dampers or the sideframe column wear plates may have a non-metallic wear plate, or wear surface, which may be replaceable, and which may tend to exhibit non-stick slip, or reduced stick slip behaviour in use. Bearing adapters may be mounted on the bearings of the wheelsets, and resilient pad members may be mounted on the bearing adapters. The pedestal seats may sit over the resilient pads. There may be a discontinuity in the vertical load path between the pedestal roof and the bearing. The discontinuity in the vertical load path may tend to shed a portion of the vertical load to either side of the top rollers of the bearing races to a greater extent than if the vertical load path discontinuity were not present.

35 Claims, 25 Drawing Sheets

U.S. PATENT DOCUMENTS

| | | | |
|---|---|---|---|
| 1,745,322 | A | 1/1930 | Brittain, Jr. |
| 1,823,884 | A | 9/1931 | Brittain, Jr. |
| 1,855,903 | A | 4/1932 | Brittain, Jr. |
| 1,902,823 | A | 3/1933 | Bender |
| 1,953,103 | A | 4/1934 | Buckwalter |
| 2,009,771 | A | 7/1935 | Goodwin |
| 2,053,990 | A | 9/1936 | Goodwin |
| 2,129,408 | A | 9/1938 | Davidson |
| 2,155,615 | A | 4/1939 | De L. Rice |
| 2,257,109 | A | 9/1941 | Davidson |
| 2,324,267 | A | 7/1943 | Oelkers |
| 2,333,921 | A | 11/1943 | Flesch |
| 2,352,693 | A | 7/1944 | Davidson |
| 2,367,510 | A | 1/1945 | Light |
| 2,404,278 | A | 7/1946 | Dath |
| 2,408,866 | A | 10/1946 | Marquardt |
| 2,424,936 | A | 7/1947 | Light |
| 2,434,583 | A | 1/1948 | Pierce |
| 2,434,838 | A | 1/1948 | Cottrell |
| 2,446,506 | A | 7/1948 | Barrett |
| 2,456,635 | A | 12/1948 | Heater |
| 2,458,210 | A | 1/1949 | Schlegel |
| 2,497,460 | A | 2/1950 | Leese |
| 2,528,473 | A | 10/1950 | Kowalik |
| 2,551,064 | A | 5/1951 | Spenner |
| 2,570,159 | A | 10/1951 | Schlegel |
| 2,613,075 | A | 10/1952 | Barrett |
| 2,650,550 | A | 9/1953 | Pierce |
| 2,661,702 | A | 12/1953 | Kowalik |
| 2,669,943 | A | 2/1954 | Spenner |
| 2,687,100 | A | 8/1954 | Dath |
| 2,688,938 | A | 9/1954 | Kowalik |
| 2,693,152 | A | 11/1954 | Bachman |
| 2,697,989 | A | 12/1954 | Shafer |
| 2,717,558 | A | 9/1955 | Shafer |
| 2,727,472 | A | 12/1955 | Forssell |
| 2,737,907 | A | 3/1956 | Janeway |
| 2,751,856 | A | 6/1956 | Maatman |
| 2,762,317 | A | 9/1956 | Palmgren |
| 2,777,400 | A | 1/1957 | Forssell |
| 2,827,987 | A | 3/1958 | Williams |
| 2,853,958 | A | 9/1958 | Neumann |
| 2,883,944 | A | 4/1959 | Couch |
| 2,911,923 | A | 11/1959 | Bachman et al. |
| 3,024,743 | A | 3/1962 | Williams et al. |
| 3,026,819 | A | 3/1962 | Cope |
| 3,218,990 | A | 11/1965 | Weber |
| 3,274,955 | A | 9/1966 | Thomas |
| 3,285,197 | A | 11/1966 | Tack |
| 3,302,589 | A | 2/1967 | Williams |
| 3,381,629 | A | 5/1968 | Jones |
| 3,461,814 | A | 8/1969 | Weber et al. |
| 3,461,815 | A | 8/1969 | Gedris et al. |
| 3,517,620 | A | 6/1970 | Weber |
| 3,559,589 | A | 2/1971 | Williams |
| 3,575,117 | A | 4/1971 | Tack |
| 3,638,582 | A | 2/1972 | Beebe |
| 3,670,660 | A | 6/1972 | Weber et al. |
| 3,687,086 | A | 8/1972 | Barber |
| 3,699,897 | A | 10/1972 | Sherrick |
| 3,714,905 | A | 2/1973 | Barber |
| 3,785,298 | A | 1/1974 | Reynolds |
| 3,802,353 | A | 4/1974 | Korpics |
| 3,834,320 | A | 9/1974 | Tack |
| 3,844,226 | A | 10/1974 | Brodeur et al. |
| 3,855,942 | A | 12/1974 | Mulcahy |
| 3,857,341 | A | 12/1974 | Neumann |
| 3,880,089 | A | 4/1975 | Wallace |
| 3,885,942 | A | 5/1975 | Moore |
| 3,897,736 | A | 8/1975 | Tack |
| 3,901,163 | A | 8/1975 | Neumann |
| 3,905,305 | A | 9/1975 | Cope |
| 3,920,231 | A | 11/1975 | Harrison |
| 3,965,825 | A | 6/1976 | Sherrick |
| 3,977,332 | A | 8/1976 | Bullock |
| 3,995,720 | A | 12/1976 | Wiebe |
| 4,003,318 | A | 1/1977 | Bullock et al. |
| 4,034,681 | A | 7/1977 | Neumann et al. |
| 4,067,260 | A | 1/1978 | Scheffel |
| 4,072,112 | A | 2/1978 | Wiebe |
| 4,078,501 | A | 3/1978 | Neumann |
| 4,084,514 | A | 4/1978 | Bullock |
| 4,103,623 | A | 8/1978 | Radwill |
| 4,109,585 | A | 8/1978 | Brose |
| 4,109,856 | A | 8/1978 | Briggs et al. |
| 4,109,934 | A | 8/1978 | Paton et al. |
| 4,111,131 | A | 9/1978 | Bullock |
| 4,136,620 | A | 1/1979 | Scheffel et al. |
| 4,148,469 | A | 4/1979 | Geyer |
| 4,151,801 | A | 5/1979 | Scheffel et al. |
| 4,167,907 | A | 9/1979 | Mulcahy et al. |
| 4,179,995 | A | 12/1979 | Day |
| 4,186,914 | A | 2/1980 | Radwill et al. |
| 4,192,240 | A | 3/1980 | Korpics |
| 4,196,672 | A | 4/1980 | Bullock |
| 4,230,047 | A | 10/1980 | Wiebe |
| 4,236,457 | A | 12/1980 | Cope |
| 4,237,793 | A | 12/1980 | Holden et al. |
| 4,239,007 | A | 12/1980 | Kleycamp et al. |
| 4,242,966 | A | 1/1981 | Holt et al. |
| 4,244,297 | A | 1/1981 | Monselle |
| 4,254,712 | A | 3/1981 | O'Neill |
| 4,254,713 | A | 3/1981 | Clafford |
| 4,256,041 | A | 3/1981 | Kemper et al. |
| 4,265,182 | A | 5/1981 | Neff et al. |
| 4,274,339 | A | 6/1981 | Cope |
| 4,274,340 | A | 6/1981 | Neumann et al. |
| 4,276,833 | A | 7/1981 | Bullock |
| 4,295,429 | A | 10/1981 | Wiebe |
| 4,311,098 | A | 1/1982 | Irwin |
| 4,316,417 | A | 2/1982 | Martin |
| 4,332,201 | A | 6/1982 | Pollard et al. |
| 4,333,403 | A | 6/1982 | Tack et al. |
| RE31,008 | E | 8/1982 | Barber |
| 4,342,266 | A | 8/1982 | Cooley |
| 4,351,242 | A | 9/1982 | Irwin |
| 4,356,775 | A | 11/1982 | Paton et al. |
| 4,357,880 | A | 11/1982 | Weber |
| 4,363,276 | A | 12/1982 | Neumann |
| 4,363,278 | A | 12/1982 | Mulcahy |
| 4,370,933 | A | 2/1983 | Mulcahy |
| 4,373,446 | A | 2/1983 | Cope |
| 4,413,569 | A | 11/1983 | Mulcahy |
| 4,416,203 | A | 11/1983 | Sherrick |
| 4,426,934 | A | 1/1984 | Geyer |
| 4,434,720 | A | 3/1984 | Mulcahy et al. |
| 4,444,122 | A | 4/1984 | Dickhart, III |
| 4,483,253 | A | 11/1984 | List |
| RE31,784 | E | 1/1985 | Wiebe |
| 4,491,075 | A | 1/1985 | Neumann |
| 4,512,261 | A | 4/1985 | Horger |
| 4,526,109 | A | 7/1985 | Dickhart et al. |
| 4,537,138 | A | 8/1985 | Bullock |
| RE31,988 | E | 9/1985 | Wiebe |
| 4,552,074 | A | 11/1985 | Mulcahy et al. |
| 4,554,875 | A | 11/1985 | Schmitt et al. |
| 4,574,708 | A | 3/1986 | Solomon |
| 4,590,864 | A | 5/1986 | Przyblinski |
| 4,637,319 | A | 1/1987 | Moehling et al. |
| 4,660,476 | A | 4/1987 | Franz |
| 4,674,411 | A | 6/1987 | Schindehutte |
| 4,674,412 | A | 6/1987 | Mulcahy et al. |
| 4,676,172 | A | 6/1987 | Bullock |
| 4,765,251 | A | 8/1988 | Guins |

| | | | | |
|---|---|---|---|---|
| 4,785,740 | A | | 11/1988 | Grandy |
| 4,813,359 | A | | 3/1989 | Marulic et al. |
| 4,825,775 | A | | 5/1989 | Stein et al. |
| 4,825,776 | A | | 5/1989 | Spencer |
| 4,870,914 | A | | 10/1989 | Radwill |
| 4,915,031 | A | | 4/1990 | Wiebe |
| 4,936,226 | A | | 6/1990 | Wiebe |
| 4,938,152 | A | | 7/1990 | List |
| 4,953,471 | A | | 9/1990 | Wronkiewicz et al. |
| 4,974,521 | A | | 12/1990 | Eungard |
| 4,986,192 | A | | 1/1991 | Wiebe |
| 5,000,097 | A | | 3/1991 | List |
| 5,001,989 | A | | 3/1991 | Mulcahy et al. |
| 5,009,521 | A | | 4/1991 | Wiebe |
| 5,027,716 | A | | 7/1991 | Weber |
| 5,046,431 | A | * | 9/1991 | Wagner ..... 105/198.4 |
| 5,081,935 | A | | 1/1992 | Pavlick |
| 5,086,708 | A | | 2/1992 | McKeown, Jr. et al. |
| 5,095,823 | A | | 3/1992 | McKeown, Jr. |
| 5,107,773 | A | | 4/1992 | Daley et al. |
| 5,111,753 | A | | 5/1992 | Zigler et al. |
| 5,138,954 | A | | 8/1992 | Mulcahy |
| 5,174,218 | A | | 12/1992 | List |
| 5,176,083 | A | | 1/1993 | Bullock |
| 5,226,369 | A | | 7/1993 | Weber |
| 5,235,918 | A | | 8/1993 | Durand et al. |
| 5,237,933 | A | | 8/1993 | Bucksbee |
| 5,239,932 | A | | 8/1993 | Weber |
| 5,241,913 | A | | 9/1993 | Weber |
| 5,327,837 | A | | 7/1994 | Weber |
| 5,331,902 | A | | 7/1994 | Hawthorne et al. |
| 5,404,826 | A | * | 4/1995 | Rudibaugh et al. ..... 105/222 |
| 5,410,968 | A | | 5/1995 | Hawthorne et al. |
| 5,417,163 | A | | 5/1995 | Lienard |
| RE34,963 | E | | 6/1995 | Eungard |
| 5,450,799 | A | | 9/1995 | Goding |
| 5,452,665 | A | | 9/1995 | Wronkiewicz et al. |
| 5,463,964 | A | | 11/1995 | Long et al. |
| 5,481,986 | A | | 1/1996 | Spencer et al. |
| 5,503,084 | A | | 4/1996 | Goding et al. |
| 5,509,358 | A | | 4/1996 | Hawthorne |
| 5,511,489 | A | | 4/1996 | Bullock |
| 5,524,551 | A | | 6/1996 | Hawthorne et al. |
| 5,544,591 | A | | 8/1996 | Taillon |
| 5,555,817 | A | | 9/1996 | Taillon |
| 5,555,818 | A | | 9/1996 | Bullock |
| 5,562,045 | A | | 10/1996 | Rudibaugh et al. |
| 5,572,931 | A | | 11/1996 | Lazar |
| 5,613,445 | A | | 3/1997 | Rismiller |
| 5,632,208 | A | | 5/1997 | Weber |
| 5,647,283 | A | | 7/1997 | McKisic |
| 5,666,885 | A | | 9/1997 | Wike |
| 5,722,327 | A | | 3/1998 | Hawthorne et al. |
| 5,735,216 | A | | 4/1998 | Bullock et al. |
| 5,746,137 | A | | 5/1998 | Hawthorne |
| 5,749,301 | A | | 5/1998 | Wronkiewicz et al. |
| 5,794,538 | A | | 8/1998 | Pitchford |
| 5,799,582 | A | | 9/1998 | Rudibaugh et al. |
| 5,802,982 | A | | 9/1998 | Weber |
| 5,850,795 | A | | 12/1998 | Taillon |
| 5,875,721 | A | | 3/1999 | Wright et al. |
| 5,918,547 | A | | 7/1999 | Bullock |
| 5,921,186 | A | | 7/1999 | Hawthorne et al. |
| 5,924,366 | A | | 7/1999 | Trainer et al. |
| 5,943,961 | A | | 8/1999 | Rudibaugh et al. |
| 5,967,053 | A | | 10/1999 | Toussaint et al. |
| 5,992,330 | A | | 11/1999 | Gilbert et al. |
| 6,125,767 | A | | 10/2000 | Hawthorne et al. |
| 6,142,081 | A | | 11/2000 | Long |
| 6,173,655 | B1 | | 1/2001 | Hawthorne |
| 6,178,894 | B1 | | 1/2001 | Leingang |
| 6,186,075 | B1 | | 2/2001 | Spencer |
| 6,227,122 | B1 | | 5/2001 | Spencer |
| 6,269,752 | B1 | | 8/2001 | Taillon |
| 6,276,283 | B1 | | 8/2001 | Weber |
| 6,338,300 | B1 | | 1/2002 | Landrot |
| 6,347,588 | B1 | | 2/2002 | Leingang |
| 6,371,033 | B1 | | 4/2002 | Smith et al. |
| 6,374,749 | B1 | | 4/2002 | Duncan et al. |
| 6,422,155 | B1 | | 7/2002 | Heyden et al. |
| 6,425,334 | B1 | | 7/2002 | Wronkiewicz et al. |
| 6,591,759 | B2 | | 7/2003 | Bullock |
| 6,631,685 | B2 | | 10/2003 | Hewitt |
| 6,672,224 | B2 | | 1/2004 | Weber et al. |
| 6,688,236 | B2 | | 2/2004 | Taillon |
| 6,691,625 | B2 | | 2/2004 | Duncan |
| 6,701,850 | B2 | | 3/2004 | McCabe et al. |
| 2003/0024429 | A1 | | 2/2003 | Forbes |
| 2003/0037696 | A1 | | 2/2003 | Forbes |
| 2003/0041772 | A1 | | 3/2003 | Forbes |
| 2003/0097955 | A1 | | 5/2003 | Bullock |
| 2003/0129037 | A1 | | 7/2003 | Forbes |

FOREIGN PATENT DOCUMENTS

| | | | |
|---|---|---|---|
| CA | 2090031 | | 6/1991 |
| CA | 2153137 | | 6/1995 |
| EP | 1053925 | A1 | 11/2000 |
| GB | 2045188 | A | 10/1980 |
| WO | 00/13954 | A1 | 3/2000 |

OTHER PUBLICATIONS

1961 Car and Locomotive Cyclopedia, 21st ed. (New York: Simmons-Boardman Publishing Corporation) pp. 846-847.
1966 Car and Locomotive Cyclopedia, (New York: Simmons-Boardman Publishing Corporation) pp. 818-819.
1974 Car and Locomotive Cyclopedia, 3rd ed. (New York: Simmons-Boardman Publishing Corporation) pp. S13-36, S13-37.
1980 Car and Locomotive Cyclopedia, pp. 669-750, Section 13.
1984 Car and Locomotive Cyclopedia, 5th ed. (Omaha: Simmons-Boardman Books, Inc.) pp. 512-513.
1997 Car and Locomotive Cyclopedia, 6th ed. (Omaha: Simmons-Boardman Books, Inc.) pp. 705-770, Section 7: Trucks Wheel Axles & Bearings.
1997 Car and Locomotive Cyclopedia, 6th ed. (Omaha: Simmons-Boardman Books, Inc.) pp. 811-822, Section 7: Bearings.
1966 Car and Locomotive Cyclopedia, 1st ed. (New York: Simmons-Boardman Publishing Corporation) p. 827.
1970 Car and Locomotive Cyclopedia, 2nd ed. (New York: Simmons-Boardman Publishing Corporation) p. 816.
1984 Car and Locomotive Cyclopedia, 5th ed. (Omaha: Simmons-Boardman Books, Inc.) pp. 488, 489, 496, 500 and 526.
1997 Car and Locomotive Cyclopedia, 6th ed. (Omaha: Simmons-Boardman Books, Inc.) p. 747.
Nov. 1998 Railway Age, pp. 47, 51, 53 and 62.
Jul. 2003, "A Dynamic Relationship", Railway Age, pp. 37-38.
Railway Age, Comprehensive Railroad Dictionary (Simmons-Boardman Books, Inc.) p. 142.
Sep. 1996, Rownd, K. et al., "Improved Ride Quality of Finished Automobiles by Rail", Technology Digest TD 96-021, Association of American Railroads.
Sep. 1996, Rownd K. et al., "Over-the-Road Tests Demonstrated Improved Ride Quality for Transportation of Finished Automobiles", Technology Digest TD 96-022, Association of American Railroads.
Sep. 1997, Burnett, S. etla., "Improved Vehicle Dynamics Model for Tri-Level Auto-Rack Railcars", Technology Digest TD 97-038, Association of American Railroads.
Sep. 1997, Rownd, K. et al., "Improved Ride Quality for Rail Transport of Finished Automobiles", Technology Digest TD 97-039, Association of American Railroads.
Jun. 1998, Rownd, K. et al., "Use of Modified Suspensions to Improve Ride Quality in Bi-Level Auto-Racks", Technology Digest TD 98-014, Association of American Railroads.
Dec. 1998, Rownd, K. et al., "Advanced Suspensions Meet Performance Standards for Bi-Level Auto-Rack Cars", Technology Digest TD 98-032, Association of American Railroads.

Oct. 1998, Rownd, K. et al., "Improved Ride-Quality for Transportation of Finished Autos by Tri-Level Autorack", Technology Digest TD 98-025, Association of American Railroads.
Jun. 1999, Rownd, K. et al., "Advanced Suspensions Meet Ride-Quality Performance Standards for Tri-Level Autorack", Technology Digest TD 99-020, Association of American Railroads.
Jun. 1999, Rownd, K. et al., "Evaluation of End-of-Car Cushioning Designs Using the TOES Model", Technology Digest TD 99-019, Association of American Railroads.
Aug. 1999, Rownd, K. et al., "Improving the Economy of Bulk-Commodity Servce Through Improved Suspensions", Technology Digest TD 99-027, Association of American Railroads.
Jul. 2000, Rownd, K. et al., "Improving the Economics of Bulk-Commodity Service: ASF Bulk Truck", Technology Digest TD 00-011, Association of American Railroads.
Jul. 2000, Rownd, K. et al., "Improving the Economics of Bulk-Commodity Service—S2E Standard Car Truck", Technology Digest TD 00-012, Association of American Railroads.
ASF Trucks "Good for the Long Run", American Steel Foundries, date unknown.
ASF User's Guide, "Freight Car Truck Design", American Steel Foundries, ASF652, date unknown.
ADAPTERPlus, Pennsy Corporation, Internet—Pennsy.com, Ver. 9807, date unknown.
User's Manual for NUCARS, Version 2.0, SD-043m, pp. 5-39 and 5-40.
Barber S-2-D Product Bulletin.
Association of American Railroads Mechanical Division Manual of Standards and Recommended Practices Journal "Roller Bearing Adapters for Freight Cars", date unknown, pp. H-35 to H-42, 1989.
Narrow Pedestal Side Frames Trucks, Timken Roller Bearing Company, date unknown.
Timken "AP" Bearing Assembly, Timken Roller Bearing Company, date unknown.
Buckeye XC-R VII, Buckeye Steel Castings, date unknown.
Buckeye SC-R, Buckeye Steel Castings, date unknown.
Standard Car Truck Company, Truck Information Package 2000: Iron Friction Wedge Replacement Guide, Standard Car Truck Company, 2000; Lifeguard Friction Wedge Replacement Guide, Standard Car Truck Company, 2000; TwinGuard Friction Wedge Replacement Guide, Standard Car Truck Company, 2000; Product Bulletin, Barber TwinGuard, Standard Car Truck Company, date unknown; Barber Split Wedge, Standard Car Truck Company, date unknown; Barber Split Wedge Replacement Guide, Standard Car Truck Company, 2000.
Standard Car Truck Company, Truck Information Package 2000 (continued): Barber 905-SW Split Wedge Friction Casting, Standard Car Truck Company, 2000; Barber 905-SW Split Wedge Pocket Insert, Standard Car Truck Company, 2000; Barber 905-SW Split Wedge Insert Application Guide, Standard Car Truck Company, 2000.
Standard Car Truck Company Barber Stabilized Trucks presentation Oct. 10, 2000.
Standard Car Truck Company, "Barber Change Brings Choices", date unknown.
Standard Car Truck Company Barber Friction Wedge Matrix, date unknown.
Standard Car Truck Company Barber Stabilized Truck—Suspension Performance Properties, Mar. 14, 2000.
European Examination Report for EP 04 737 932.6, Aug. 22, 2007.
National Steel Car Pending and Issued Truck and Suspension Cases as of Jan. 6, 2006.
PCT/CA2004/000995 Search Report and Written Opinion.

* cited by examiner $L_{Pendulum}$

RAIL ROAD CAR AND BEARING ADAPTER FITTINGS THEREFOR

This application is a continuation of U.S. application Ser. No. 11/019,664 filed Dec. 23, 2004, which is hereby incorporated by reference.

FIELD OF THE INVENTION

This invention relates to the field of rail road cars, and, more particularly, to the field of trucks for rail road cars.

BACKGROUND OF THE INVENTION

Rail road cars in North America commonly employ double axle swiveling trucks known as "three piece trucks" to permit them to roll along a set of rails. The three piece terminology refers to a truck bolster and pair of first and second sideframes. In a three piece truck, the truck bolster extends cross-wise relative to the sideframes, with the ends of the truck bolster protruding through the sideframe windows. Forces are transmitted between the truck bolster and the sideframes by spring groups mounted in spring seats in the sideframes. The sideframes carry forces to the sideframe pedestals. The pedestals seat on bearing adapters, whence forces are carried in turn into the bearings, the axles, the wheels, and finally into the tracks. The 1980 *Car & Locomotive Cyclopedia* states at page 669 that the three piece truck offers "interchangeability, structural reliability and low first cost but does so at the price of mediocre ride quality and high cost in terms of car and track maintenance."

Ride quality can be judged on a number of different criteria. There is longitudinal ride quality, where, often, the limiting condition is the maximum expected longitudinal acceleration experienced during humping or flat switching, or slack run-in and run-out. There is vertical ride quality, for which vertical force transmission through the suspension is the key determinant. There is lateral ride quality, which relates to the lateral response of the suspension. There are also other phenomena to be considered, such as truck hunting, the ability of the truck to self steer, and, whatever the input perturbation may be, the ability of the truck to damp out undesirable motion. These phenomena tend to be inter-related, and the optimization of a suspension to deal with one phenomenon may yield a system that may not necessarily provide optimal performance in dealing with other phenomena.

In terms of improving truck performance, it may be advantageous to be able to obtain a relatively soft dynamic response to lateral and vertical perturbations, to obtain a measure of self steering, and yet to maintain resistance to lozenging (or parallelogramming). Lozenging, or parallelogramming, is non-square deformation of the truck bolster relative to the side frames of the truck as seen from above. Self steering may tend to be desirable since it may reduce drag and may tend to reduce wear to both the wheels and the track, and may give a smoother overall ride.

Another issue which may arise may pertain to peak loading in the rollers of the bearings. It is thought that the life of bearing components may be strongly related to the maximum cyclic load. In some instances, the cyclic load may reach a maximum when the uppermost roller in a bearing race is at the top center position, with a steep drop off to either side of the topmost roller. It may be desirable to spread this loading in an effort to moderate the peak loading as the rollers pass through the top center position.

SUMMARY OF THE INVENTION

In an aspect of the present invention there may be a bearing adapter to sideframe interface assembly for use in a railroad car truck. The interface assembly may include a bearing adapter and an elastomeric pad mounted thereon, said bearing adapter having a body having first and second arches for mating with a bearing of a rail road car wheelset, those arches being axially spaced apart to engage opposite ends of the bearing with the bearing races located axially therebetween, the arches having apices that, when installed in an at rest condition on the bearing, are axially aligned centrally over the bearing. The body of the bearing adapter has a central portion intermediate said arches, that central portion having a bearing shell engagement interface formed to seat about a portion of the circumference of the bearing shell. One of the bearing adapter and the elastomeric pad has a relieved portion axially aligned with the apices of the arches.

In an aspect of the invention there is a rail road car truck which has first and second spaced apart wheelsets, with first and second sideframes mounted to the wheelsets. There is also attached a bolster resiliently mounted cross-wise between the sideframes with each of the sideframes having a sideframe pedestal mounting at either end thereof. Each of the wheelsets including an axle having two ends and each of the axles having bearings mounted to either end thereof. The fittings defining a bearing to sideframe pedestal mounting assembly, and the assembly providing a load path for vertical loads between the sideframe pedestal mounting, and the bearing and the assembly having a vertical load path discontinuity and the discontinuity being located above top dead center of the bearing.

In a feature, the truck is a Barber S2HD rail road car truck. There is also a feature which consists of the assembly and includes a bearing adapter and a resilient member mounted between the bearing adapter and the pedestal mounting, and the bearing adapter has a laterally extending relief formed therein, the relief being located over top dead center of at least one bearing race of the bearing. In another feature, the assembly with a bearing adapter and a resilient member are mounted between the bearing adapter and the pedestal mounting. The bearing adapter has a downwardly facing interface matingly engaged with the bearing, and the downwardly facing interface includes a relief located over top dead center of at least one bearing race of the bearing, and the relief defines the vertical load path discontinuity.

In another feature, the assembly includes a bearing adapter and a resilient member which is mounted between the bearing adapter and the pedestal mounting. The bearing adapter has an upwardly facing interface matingly engaged with the resilient member, and the bearing adapter has a relief formed in the upwardly facing interface. The relief being located over top dead center of a bearing race of the bearing. The resilient member has a region of non-homogeneity and the region of non-homogeneity being located over top dead center of at least one bearing race of the bearing, and the non-homogeneity defining the discontinuity of the load path. However, the resilient member has a relief formed therein and the relief being located over top dead center of at least one bearing race of the bearing, and the non-homogeneity defining the discontinuity of the load path.

In an additional feature, the assembly includes a bearing adapter and a pair of resilient pads mounted to be squeezed vertically between the bearing adapter and the pedestal mount. The pads are spaced apart by a gap, and the gap being located over top dead center of at least, one bearing race of the bearing. In another feature, the assembly includes a bearing adapter and a resilient pad mounted over the bearing adapter, and a pedestal seat member mounted over the resilient pad. The pedestal seat member being mounted in the pedestal mount, and the pedestal seat having a relief defined therein, the relief being located over top dead center of the bearing.

In another feature, the truck has friction dampers mounted between the bolster and the sideframes. The friction dampers work on a friction interface that includes a non-metallic friction member. Also in a further feature, the sideframes each have a sideframe window defined between a pair of sideframe columns, and the non-metallic friction member is mounted to one of the sideframe columns. The friction dampers present a surface to the non-metallic member, and the surface is made from a material chosen from the set of materials consisting of (a) cast iron (b) steel; and (c) an iron based alloy other than a steel.

In another feature, the bolster has two ends, one of each ends being mounted to each of the sideframes, and the bolster has four independently sprung friction dampers mounted at each end thereof.

In another feature, the assembly includes a bearing adapter and a resilient member mounted over the bearing adapter. The resilient member bears against the pedestal mount and the bearing adapter having an upper surface having a central region lying between a pair of spaced apart side regions, the side regions having upper surfaces standing upwardly proud of the central region, the spaced apart regions having a crown radius, and the resilient member seating over the crown radius. In another feature the assembly is free of any rocker member located above the resilient member.

BRIEF DESCRIPTION OF THE DRAWINGS

These and other aspects and features of the invention may be understood with reference to the detailed descriptions of the invention and the accompanying illustrations as set forth below.

DETAILED DESCRIPTION

Figures 1A, 1B, 1C:
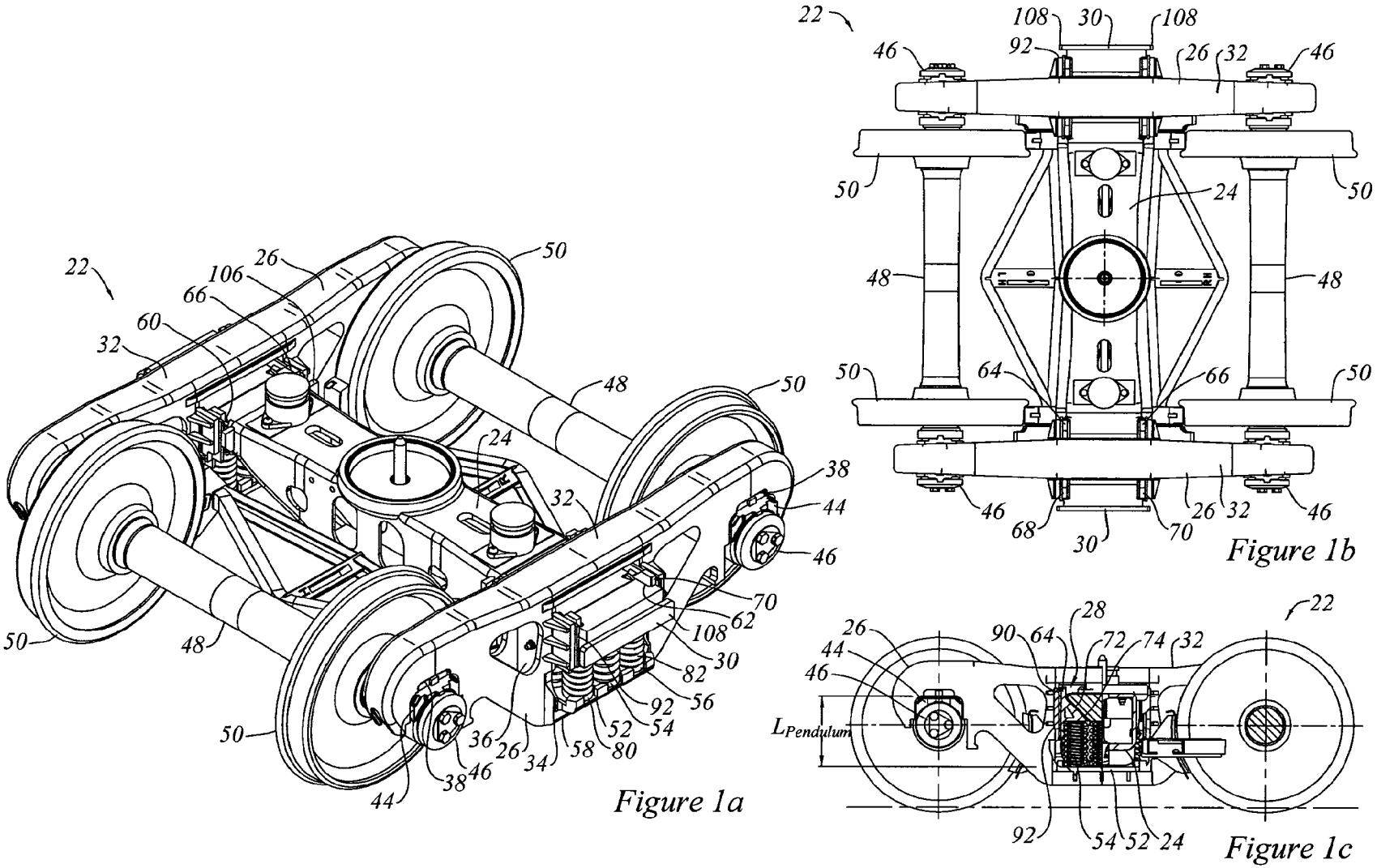
FIG. 1*a* shows an isometric view of an example of an embodiment of a railroad car truck.
FIG. 1*b* shows a top view of the railroad car truck of FIG. 1*a;*
FIG. 1*c* shows a side view of the railroad car truck of FIG. 1*a;*

The description that follows, and the embodiments described therein, are provided by way of illustration of an example, or examples, of particular embodiments of the principles of aspects of the present invention. These examples are provided for the purposes of explanation, and not of limitation, of those principles and of the invention. In the description, like parts, or similar parts to which the same nomenclature may be applied, are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road car trucks described herein, the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis.

This description relates to rail car trucks and truck components. Several AAR standard truck sizes are listed at page 711 in the 1997 *Car & Locomotive Cyclopedia*. As indicated, for a single unit rail car having two trucks, a "40 Ton" truck rating corresponds to a maximum gross car weight on rail (GWR) of 142,000 lbs. Similarly, "50 Ton" corresponds to 177,000 lbs., "70 Ton" corresponds to 220,000 lbs., "100 Ton" corresponds to 263,000 lbs., and "125 Ton" corresponds to 315,000 lbs. In each case the load limit per truck is then half the maximum gross car weight on rail. Two other types of truck are the "110 Ton" truck for railcars having a 286,000 lbs. GWR and the "70 Ton Special" low profile truck sometimes used for auto rack cars. Given that the rail road car trucks described herein tend to have both longitudinal and transverse axes of symmetry, a description of one half of an assembly may generally also be intended to describe the other half as well, allowing for differences between right hand and left hand parts.

This description refers to friction dampers for rail road car trucks, and multiple friction damper systems. There are several types of damper arrangements, some being shown at pp. 715-716 of the 1997 *Car and Locomotive Cyclopedia*, those pages being incorporated herein by reference. Each of the arrangements of dampers shown at pp. 715 to 716 of the 1997

*Car and Locomotive Cyclopedia* can be modified to employ a four cornered, double damper arrangement of inner and outer dampers.

In terms of general nomenclature, damper wedges tend to be mounted within an angled "bolster pocket" formed in an end of the truck bolster. In cross-section, each wedge may then have a generally triangular shape, one side of the triangle being, or having, a bearing face, a second side which might be termed the bottom, or base, forming a spring seat, and the third side being a sloped side or hypotenuse between the other two sides. The first side may tend to have a substantially planar bearing face for vertical sliding engagement against an opposed bearing face of one of the sideframe columns. The second face may not be a face, as such, but rather may have the form of a socket for receiving the upper end of one of the springs of a spring group. Although the third face, or hypotenuse, may appear to be generally planar, it may tend to have a slight crown, having a radius of curvature of perhaps 60". The crown may extend along the slope and may also extend across the slope. The end faces of the wedges may be generally flat, and may have a coating, surface treatment, shim, or low friction pad to give a smooth sliding engagement with the sides of the bolster pocket, or with the adjacent side of another independently slidable damper wedge, as may be.

During railcar operation, the sideframe may tend to rotate, or pivot, through a small range of angular deflection about the end of the truck bolster to yield wheel load equalization. The slight crown on the slope face of the damper may tend to accommodate this pivoting motion by allowing the damper to rock somewhat relative to the generally inclined face of the bolster pocket while the planar bearing face remains in planar contact with the wear plate of the sideframe column. Although the slope face may have a slight crown, for the purposes of this description it will be described as the slope face or as the hypotenuse, and will be considered to be a substantially flat face as a general approximation.

In the terminology herein, wedges have a primary angle $\alpha$, being the included angle between (a) the sloped damper pocket face mounted to the truck bolster, and (b) the side frame column face, as seen looking from the end of the bolster toward the truck center. In some embodiments, a secondary angle may be defined in the plane of angle $\alpha$, namely a plane perpendicular to the vertical longitudinal plane of the (undeflected) side frame, tilted from the vertical at the primary angle. That is, this plane is parallel to the (undeflected) long axis of the truck bolster, and taken as if sighting along the back side (hypotenuse) of the damper. The secondary angle $\beta$ is defined as the lateral rake angle seen when looking at the damper parallel to the plane of angle $\alpha$. As the suspension works in response to track perturbations, the wedge forces acting on the secondary angle $\beta$ may tend to urge the damper either inboard or outboard according to the angle chosen.

FIG. 1*a* shows an example of a three piece truck 22 such as might most commonly be installed under a railroad freight car body. Truck 22 may have a 3×3, 3:2:3, 5×3, 2×4, 2:3:2 or other suitable spring group arrangement, and is intended to be generically representative in this regard without need for multiple illustrations of truck variations. Truck 22 may be suitable for a variety of general purpose uses, which may include carrying relatively low density, high value lading, such as automobiles or consumer products, or for carrying denser semi-finished industrial goods, such as might be carried in rail road freight cars for transporting rolls of paper, or for carrying bulk commodities such as grain, plastic pellets, potash, ores, or coal. Truck 22 is intended to be illustrative of a wide range of truck types. Truck 22 is symmetrical about both the longitudinal and transverse, or lateral, centreline axes. In each case, where reference is made to a sideframe, it will be understood that the truck has first and second sideframes, first and second spring groups, and so on.

Truck 22 has a truck bolster 24 and sideframes 26. Each sideframe 26 has a generally rectangular window 28 (FIG. 1*d*) that accommodates one of the ends 30 of bolster 24. The upper boundary of window 28 is defined by the sideframe arch, or compression member identified as top chord member 32, and the bottom of window 28 is defined by a tension member identified as bottom chord 34. The fore and aft vertical sides of window 28 are defined by sideframe columns 36. The ends of the tension member sweep up to meet the compression member. At each of the swept-up ends of sideframe 26 there are sideframe pedestal fittings, or pedestal seats 38. Each fitting 38 accommodates an upper fitting, which may be a seat. This upper fitting, is indicated generically as 40 (FIG. 1*d*). Fitting 40 may engage a mating fitting 42 mounted to the upper surface of a bearing adapter 44. Fitting 42 may be a resilient member, and may be an elastomeric member such as, or similar to a "Pennsy" pad, that may deflect longitudinally in shear during operation to give a measure of self-steering capability to truck 22. Bearing adapter 44 engages a bearing 46 mounted on one of the ends of one of the axles 48 of the truck adjacent one of the wheels 50. A fitting 40 is located in each of the fore and aft pedestal fittings 38, the fittings 40 being longitudinally aligned.

The relationship of the mating fittings 40 and 42 is described at greater length below. The relationship of these fittings determines part of the overall relationship between an end of one of the axles of one of the wheelsets and the sideframe pedestal. That is, in determining the overall response, the degrees of freedom of the mounting of the axle end in the sideframe pedestal involve a dynamic interface across an assembly of parts, such as may be termed a wheelset to sideframe interface assembly. Several different embodiments of this wheelset to sideframe interface assembly are described below. For the purposes of this description, items 40 and 42 are intended generically to represent the combination of features of a bearing adapter and pedestal seat assembly defining the interface between the roof of the sideframe pedestal and the bearing adapter, and the six degrees of freedom of motion at that interface, namely vertical, longitudinal and transverse translation (i.e., translation in the z, x, and y directions) and pitching, rolling, and yawing (i.e., rotational motion about the y, x, and z axes respectively) in response to dynamic inputs.

The bottom chord or tension member 34 of sideframe 26 may have a basket plate, or lower spring seat 52 rigidly mounted thereto. Spring seat 52 may have retainers for engaging the springs 54 of a spring set, or spring group, 56, whether internal bosses, or a peripheral lip for discouraging the escape of the bottom ends of the springs. The spring group, or spring set 56, is captured between the distal end 30 of bolster 24 and spring seat 52, being placed under compression by the weight of the rail car body and lading that bears upon bolster 24 from above.

Bolster 24 may have double, inboard and outboard, bolster pockets 60, 62 on each face of the bolster at the outboard end (i.e., for a total of 8 bolster pockets per bolster, 4 at each end). Bolster pockets 60, 62 accommodate fore and aft pairs of first and second, laterally inboard and laterally outboard friction damper wedges 64, 66 and 68, 70, respectively. Each bolster pocket 60, 62 has an inclined face, or damper seat 72, that mates with a similarly inclined hypotenuse face 74 of the damper wedge, 64, 66, 68 and 70. Wedges 64, 66 each sit over a first, inboard corner spring 76, 78, and wedges 68, 70 each sit over a second, outboard corner spring 80, 82. Angled faces 74 of wedges 64, 66 and 68, 70 ride against the angled faces of respective seats 72. This arrangement may be referred to as a "double damper" arrangement in which a pair of laterally spaced dampers works against each sideframe column, in contrast to the arrangement of FIG. 1*e*, which shows a single damper arrangement, namely a single damper acting against each sideframe column. This arrangement of FIG. 1*d* may also be referred to as a "four cornered" damper arrangement, since there are four dampers at each end of the bolster, those four dampers being arranged in a rectangular manner.

A middle end spring 96 bears on the underside of a land 98 located intermediate bolster pockets 60 and 62. The top ends of the central row of springs, 100, seat under the main central portion 102 of the end of bolster 24. In this four corner arrangement, each damper is individually sprung by one or another of the springs in the spring group. The static compression of the springs under the weight of the car body and lading tends to act as a spring loading to bias the damper to act along the slope of the bolster pocket to force the friction surface against the sideframe. Friction damping is provided when the vertical sliding faces 90 of the friction damper wedges 64, 66 and 68, 70 ride up and down on friction wear plates 92 mounted to the inwardly facing surfaces of sideframe columns 36. In this way the kinetic energy of the motion is, in some measure, converted through friction to heat. This friction may tend to damp out the motion of the bolster relative to the sideframes.

The bearing plate, namely sideframe column wear plate 92 (FIG. 1*a*) may be significantly wider than the through thickness of the sideframes more generally, as measured, for example, at the pedestals, and may tend to be wider than has been conventionally common. This additional width corresponds to the additional overall damper span width measured fully across the damper pairs, plus lateral travel. That is, rather than having the width of one coil, plus allowance for travel, plate 92 may have the width of three coils, plus allowance to accommodate travel to either side. Bolster 24 has inboard and outboard gibs 106, 108 respectively, that bound the lateral motion of bolster 24 relative to sideframe columns 36.

The lower ends of the springs of the entire spring group, identified generally as 58, seat in lower spring seat 52. Lower spring seat 52 may be laid out as a tray with an upturned rectangular peripheral lip. Although truck 22 employs a spring group in a 3×3 arrangement, this is intended to be generic, and to represent a range of variations. They may represent 3×5, 2×4, 3:2:3 or 2:3:2 arrangement, or some other, and may include a hydraulic snubber, or such other arrangement of springs may be appropriate for the given service for the railcar for which the truck is intended.

FIGS. 1*f*-1*j*

FIGS. 1*f* to 1*j* pertain to an embodiment of sideframe such as may be used in truck 22. The friction damper elements, often damper wedges, mounted in the bolster pockets may be made of iron or steel, and may not necessarily have non-metallic wear members. In one embodiment where cast iron or steel wedges are used, with cast iron or steel friction faces oriented to face toward, and to work against, the sideframe columns, a sideframe 120 may include sideframe columns 122, 124 on either side of the sideframe window 28. Those sideframe columns may support a wear plate backing member, or backing frame 126. Backing frame 126 may have angled gusset reinforcement, and internal web reinforcements outside and inside the sideframe castings. A wear plate member 130 may be mounted to backing frame 126. Wear plate 130 may have countersunk bores, as at 132, by which fasteners may be introduced to mount wear plate 130 in place. Wear plate 130 may be made of an iron or steel member for working against a non-metallic shoe, or wear member of an opposed damper. Alternatively, wear plate 130 may be a non-metallic friction member, akin to a brake shoe or clutch lining, such as may be replaced from time to time when worn. In one embodiment, wear plate 130 may be made of, or faced with, a non-metallic wear material having a tendency not to exhibit stick slip behaviour when working in co-operation with steel or iron faced dampers. Wear member 130 may have dynamic and static coefficients of friction that are, or are substantially, the same. Those coefficients of friction may be in the range of 0.15 to 0.35, and may be about 0.20 (+/−20%) or may be about 0.30 (+/−20%)

Figure 1E:
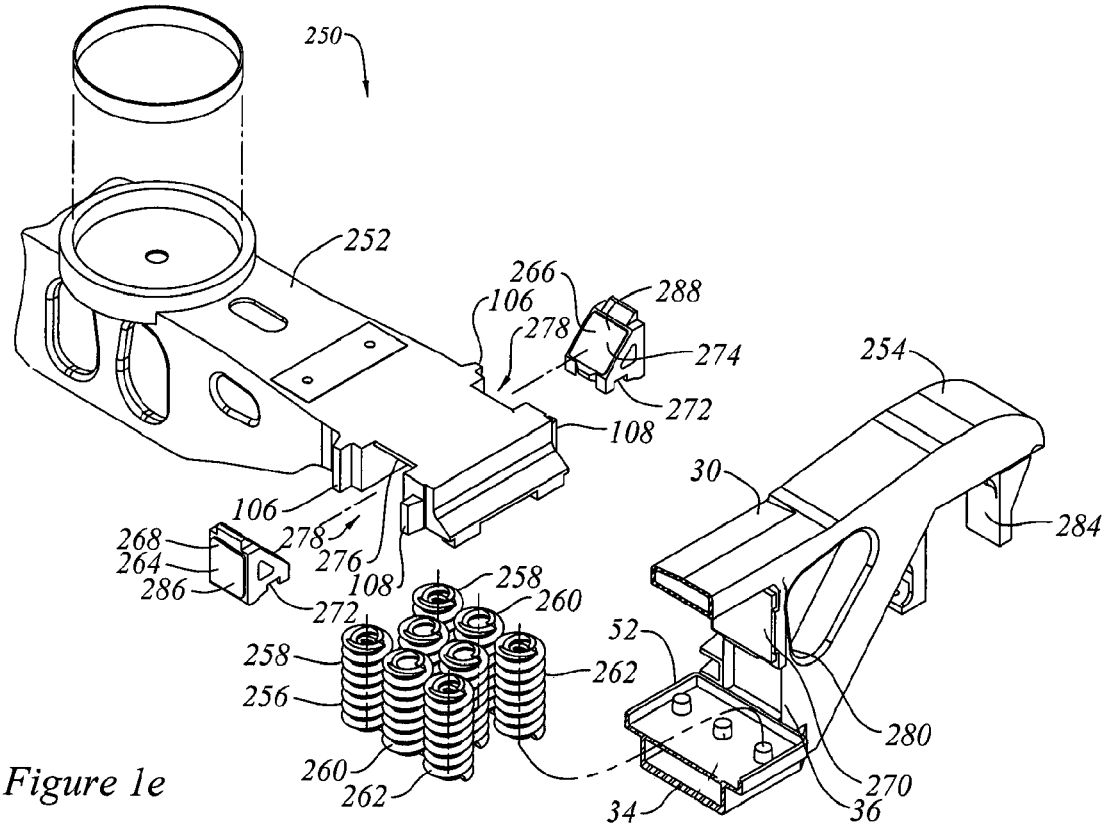
FIG. 1*e* is an exploded view of an example of an alternate three piece truck to that of FIG. 1*a*, having dampers mounted along the spring group centerlines.
Figure 1D:
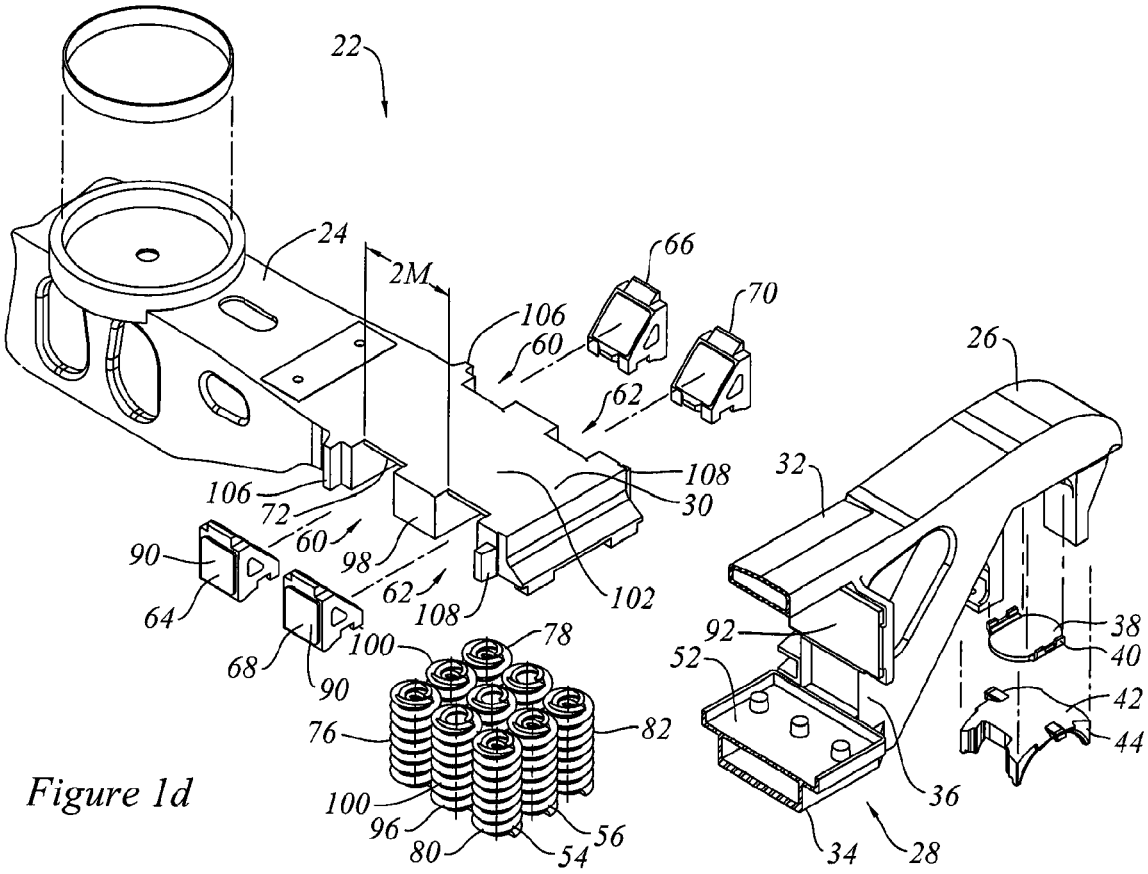
FIG. 1*d* shows an exploded view of a portion of a truck similar to that of FIG. 1*a;*
Figure 1F:
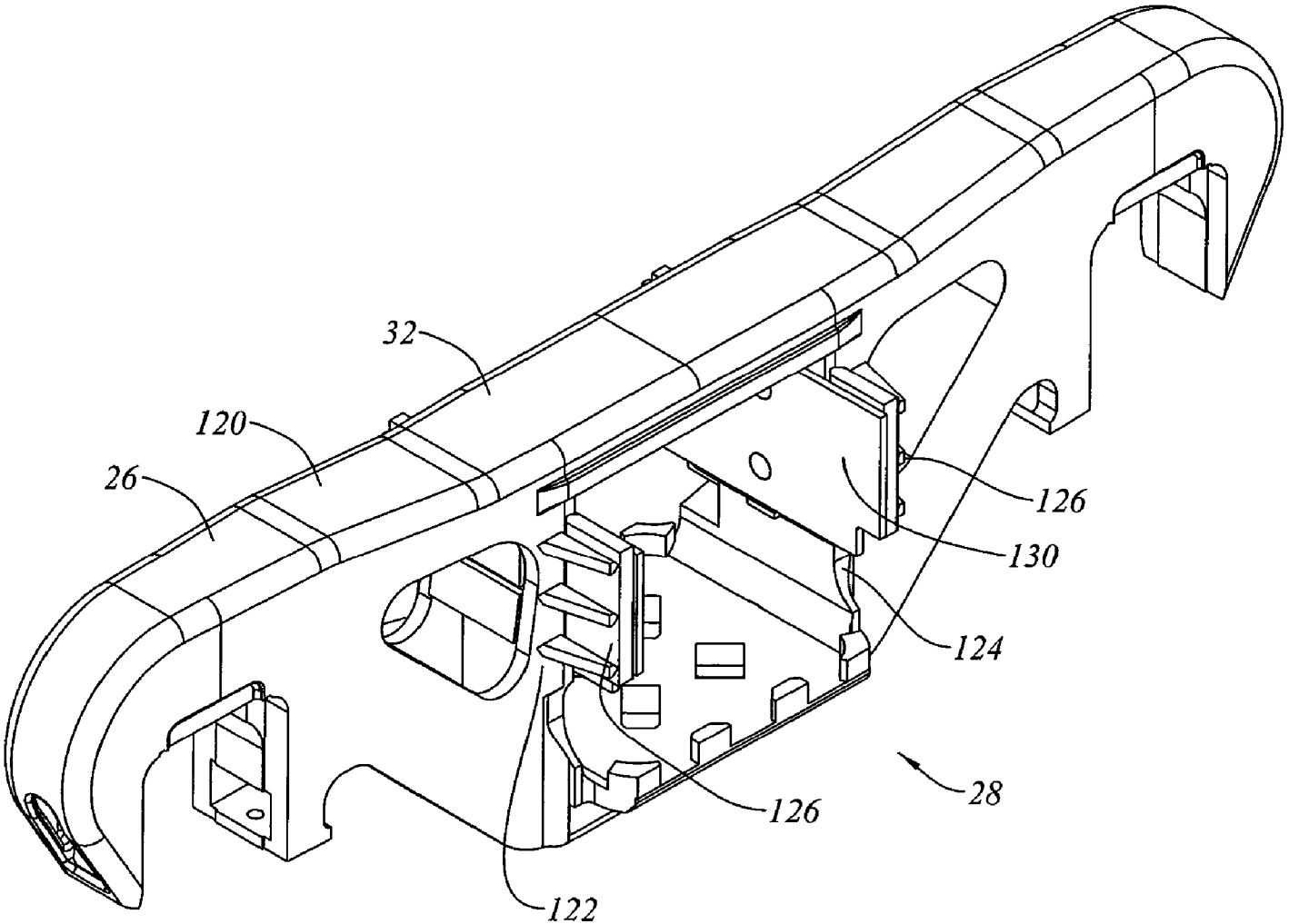
FIG. 1*f* shows an isometric view of a sideframe such as might be employed in an embodiment of the railroad car truck of FIG. 1*a;*
Figure 1H:
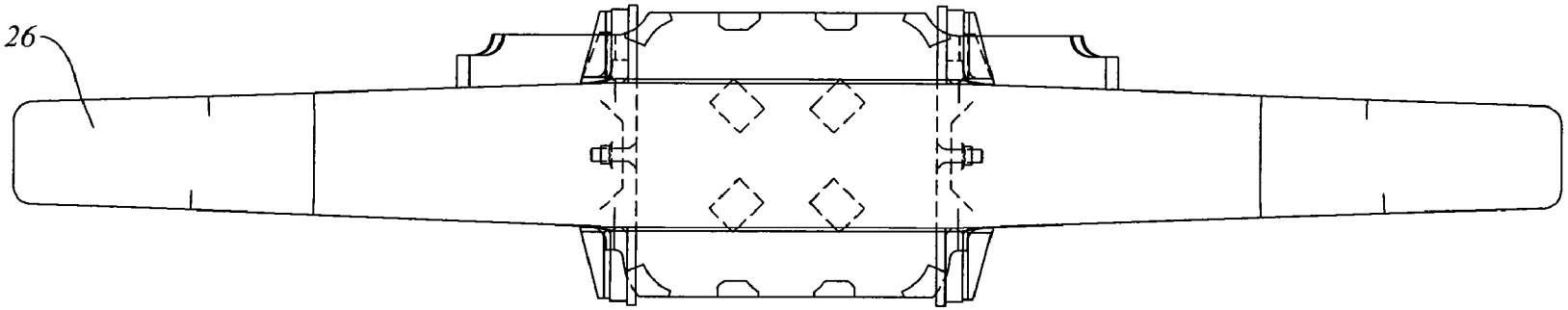
FIG. 1*h* shows a top view of the sideframe of FIG. 1*f;*
Figure 1G:
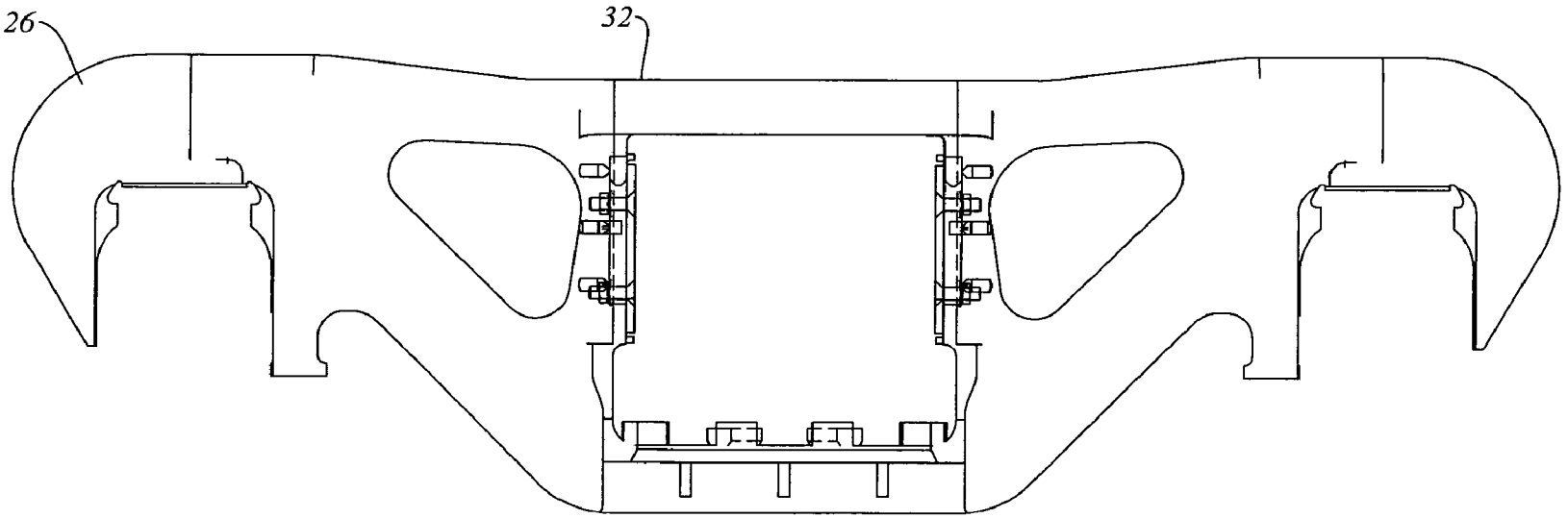
FIG. 1*g* shows a side view of the sideframe of FIG. 1*f;*
Figure 1J:
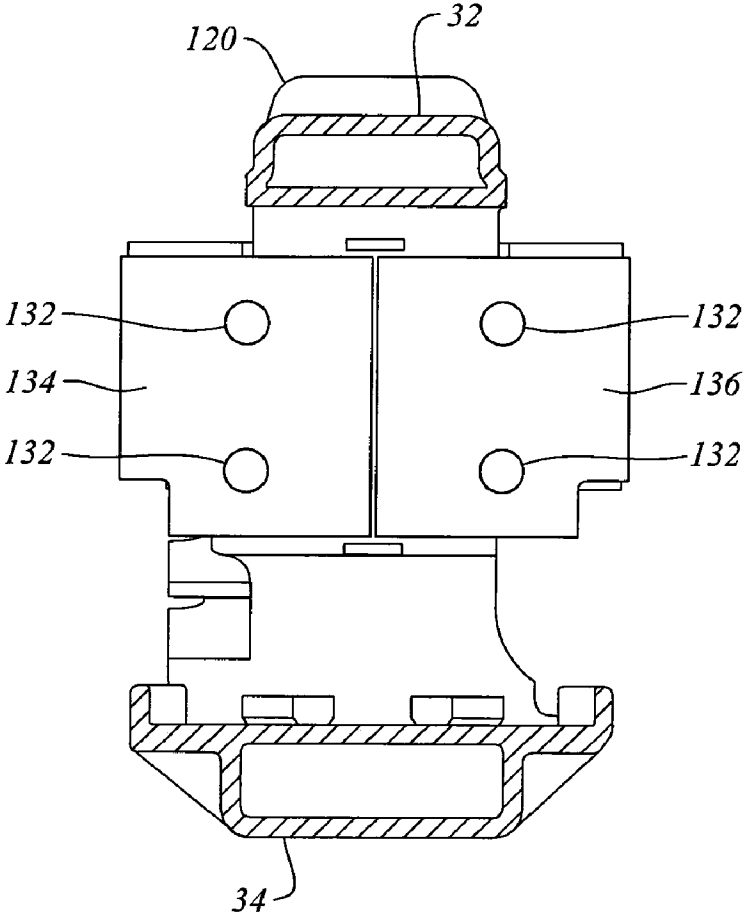
FIG. 1*j* shows an alternate arrangement to that of FIG. 1*i;*
Figure 1I:
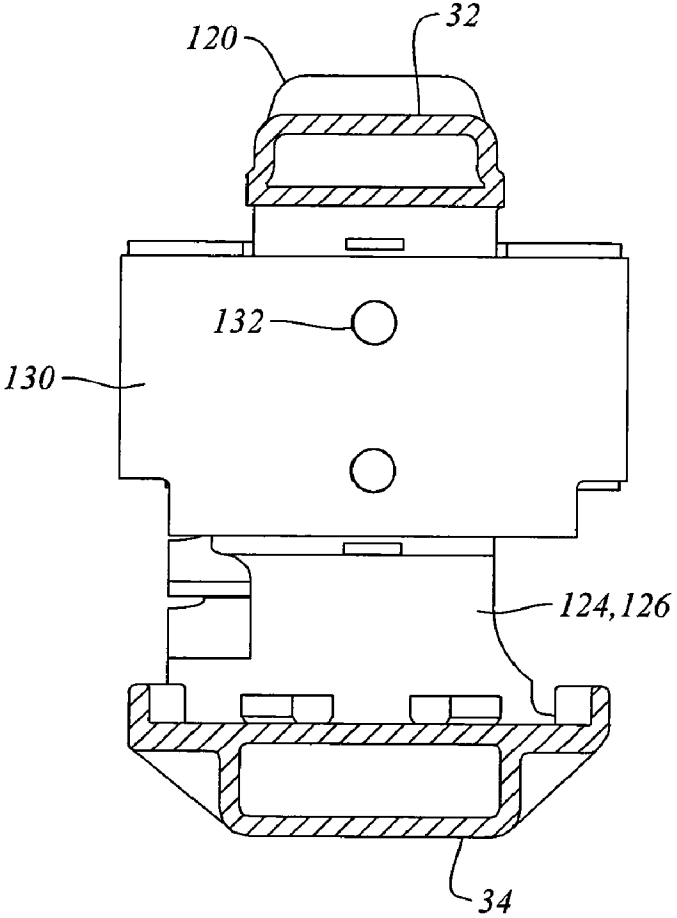
FIG. 1*i* shows a view looking along the longitudinal axis of the sideframe toward the sideframe column, taken on '1*i*-1*i*' in FIG. 1*g;*

In one embodiment, illustrated in FIG. 1*j*, sideframe 120 has a dual wear plate mounting, where left and right hand wear plate portions 134 and 136 are mounted side-by-side by mechanical fasteners to the sideframe column.

In either FIG. 1*f* or FIG. 1*j*, the frontal area of the non-metallic member may exceed, and may substantially exceed, the surface area of the steel or cast iron member working against it. For example, in one embodiment, the area of the non-metallic friction wear member mounted to the sideframe column is more than twice as great as the working surface of the front face of the co-operable damper wedge.

FIG. 1*e*

FIG. 1*e* shows an example of an alternate three piece railroad car truck, shown generally as 250. Truck 250 has a truck bolster 252, and a pair of sideframes 254. The spring groups of truck 250 are indicated as 256. Spring groups 256 are spring groups having three springs 258 (inboard corner), 260 (center) and 262 (outboard corner) most closely adjacent to the sideframe columns 254. A motion calming, kinematic energy dissipating element, in the nature of a friction damper 264, 266 is mounted over each of central springs 260.

Friction damper 264, 266 has a substantially planar friction face 268 mounted in facing, planar opposition to, and for engagement with, a side frame wear member in the nature of a wear plate 270 mounted to sideframe column 254. The base of damper 264, 266 defines a spring seat, or socket 272 into which the upper end of central spring 260 seats. Damper 264, 266 has a third face, being an inclined slope or hypotenuse face 274 for mating engagement with a sloped face 276 inside sloped bolster pocket 278. Compression of spring 260 under an end of the truck bolster may tend to load damper 264 or 266, as may be, such that friction face 268 is biased against the opposing bearing face of the sideframe column, 280. Truck 250 also has wheelsets whose bearings are mounted in the pedestal 284 at either ends of the side frames 254. Each of these pedestals may accommodate one or another of the sideframe to bearing adapter interface assemblies described above and may thereby have a measure of self steering.

FIG. 2

Figure 2:
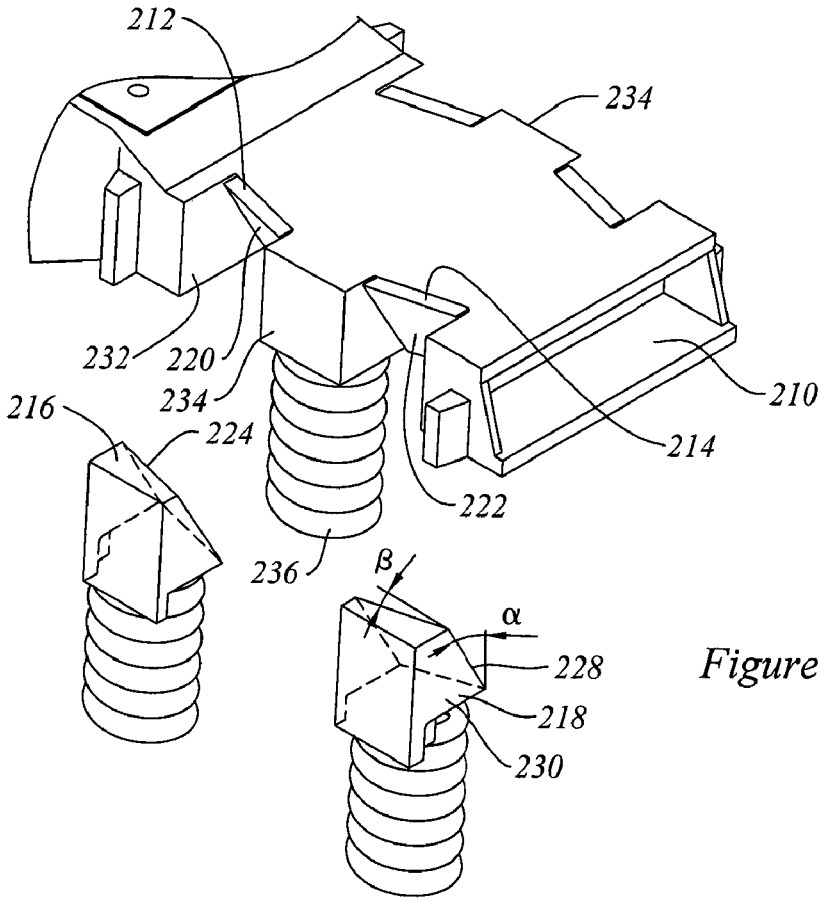
FIG. 2 shows an alternate bolster, generally similar to that shown in FIG. 1*d*, with a pair of spaced apart bolster pockets, having inserts and wedges with primary and secondary angles.

Damper wedges with only primary wedge angles may be used, whether in the truck of FIG. 1*a* or FIG. 1*e*. However, in some embodiments a truck such as truck 22 may employ wedges having both primary wedge angles and secondary wedge angles. FIG. 2 shows an isometric view of an end portion of a truck bolster 210 such as might be used in truck 22 of FIG. 1*a*. Bolster 210 is symmetrical about the central longitudinal vertical plane of the bolster (i.e., cross-wise relative to the truck generally) and symmetrical about the vertical mid-span section of the bolster (i.e., the longitudinal plane of symmetry of the truck generally, coinciding with the railcar longitudinal center line). Bolster 210 has a pair of spaced apart bolster pockets 212, 214 for receiving damper wedges 216, 218. Pocket 212 is laterally inboard of pocket 214 relative to the side frame of the truck more generally. Wear plate inserts 220, 222 are mounted in pockets 212, 214 along the angled wedge face.

Wedges 216, 218 have a primary angle, α as measured between vertical and the angled trailing vertex 228 of outboard face 230. For the embodiments discussed herein, primary angle α may tend to lie in the range of 35-55 degrees, possibly about 40-50 degrees. This same angle α is matched by the facing surface of the bolster pocket, be it 212 or 214. A secondary angle β gives the inboard, (or outboard), rake of the sloped surface 224, (or 226) of wedge 216 (or 218). The true rake angle can be seen by sighting along plane of the sloped face and measuring the angle between the sloped face and the planar outboard face 230. The rake angle is the complement of the angle so measured. The rake angle may tend to be greater than 5 degrees, may lie in the range of 5 to 20 degrees, and is preferably about 10 to 15 degrees. A modest rake angle may be desirable.

When the truck suspension works in response to track perturbations, the damper wedges may tend to work in their pockets. The rake angles yield a component of force tending to bias the outboard face 230 of outboard wedge 218 outboard against the opposing outboard face of bolster pocket 214. Similarly, the inboard face of wedge 216 may tend to be biased toward the inboard planar face of inboard bolster pocket 212. These inboard and outboard faces of the bolster pockets may be lined with a low friction surface pad, indicated generally as 232. The left hand and right hand biases of the wedges may tend to keep them apart to yield the full moment arm distance intended, and, by keeping them against the planar facing walls, may tend to discourage twisting of the dampers in the respective pockets.

Bolster 210 includes a middle land 234 between pockets 212, 214, against which another spring 236 may work. Middle land 234 is such as might be found in a spring group that is three (or more) coils wide. However, whether two, three, or more coils wide, and whether employing a central land or no central land, bolster pockets can have both primary and secondary angles as illustrated in the example embodiment of FIG. 5*a*, with or without wear inserts.

Where a central land, e.g., land 234, separates two damper pockets, the opposing side frame column wear plates need not be monolithic. That is, two wear plate regions could be provided, one opposite each of the inboard and outboard dampers, presenting planar surfaces against which the dampers can bear. The normal vectors of those regions may be parallel, the surfaces may be co-planar and perpendicular to the long axis of the side frame, and may present a clear, un-interrupted surface to the friction faces of the dampers.

FIGS. 3*a*-3*h*

Referring to FIGS. 3*a*-3*e*, a damper, which may be in the form of a damper wedge 310 is shown such as may be used in truck 22, or any other double damper truck described herein, such as may have appropriately formed, mating bolster pockets. Damper 310 is similar to damper 300, but may include both primary and secondary angles. Damper 310 may, arbitrarily, be termed a right handed damper wedge. FIGS. 3*a*-3*e* are intended to be generic such that it may be understood also to represent the left handed, mirror image of a mating damper with which damper 310 would form a matched pair.

Damper 310 has a body 312 that may be made by casting or by another suitable process. Body 312 may be made of steel or cast iron, and may be substantially hollow. Body 312 has a first, substantially planar platen portion 314 having a first face for placement in a generally vertical orientation in opposition to a sideframe bearing surface, for example, a wear plate mounted on a sideframe column. Platen portion 314 may have a rebate, or relief, or depression formed therein to receive a bearing surface wear member, indicated as member 316. Member 316 may be a material having specific friction properties when used in conjunction with the sideframe column wear plate material. For example, member 316 may be formed of a brake lining material, and the column wear plate may be formed from a high hardness steel. This material may be formed as a removable and replaceable pad or block. Alternatively, damper wedge 310 may have steel or cast iron wear plates for member 316, or may dispense with a wear plate insert, and may employ a monolithic steel or cast iron wedge. Such a wedge may work against a non-metallic wear plate member mounted to the sideframe column, as described in the context of FIGS. 1*f* to 1*j* herein.

Body 312 may include a base portion 318 that may extend rearwardly from, and generally perpendicularly to, platen portion 314. Base portion 318 may have a relief 320 formed therein in a manner to form, roughly, the negative impression of an end of a spring coil, such as may receive a top end of a coil of a spring of a spring group, such as spring 262. Base portion 318 may join platen portion 314 at an intermediate height, such that a lower portion 321 of platen portion 314 may depend downwardly therebeyond in the manner of a skirt. That skirt portion may include a corner, or wrap around portion 322 formed to seat around a portion of the spring.

Body 312 may also include a diagonal member in the nature of a sloped member 324. Sloped member 324 may have a first, or lower end extending from the distal end of base portion 318 and running upwardly and forwardly toward a junction with platen portion 314. An upper region 326 of platen portion 314 may extend upwardly beyond that point of junction, such that damper wedge 310 may have a footprint having a vertical extent somewhat greater than the vertical extent of sloped member 324. Sloped member 324 may also have a socket or seat in the nature of a relief or rebate 328 formed therein for receiving a sliding face member 330 for engagement with the bolster pocket wear plate of the bolster pocket into which wedge 310 may seat. As may be seen, sloped member 324 (and face member 330) are inclined at a primary angle α, and a secondary angle β. Sliding face member 330 may be an element of chosen, possibly relatively low, friction properties (when engaged with the bolster pocket wear plate), such as may include desired values of coefficients of static and dynamic friction. In one embodiment the coefficients of static and dynamic friction may be substantially equal, may be about 0.2 (+/−20%, or, more narrowly +/−10%), and may be substantially free of stick-slip behaviour.

Figure 3H:
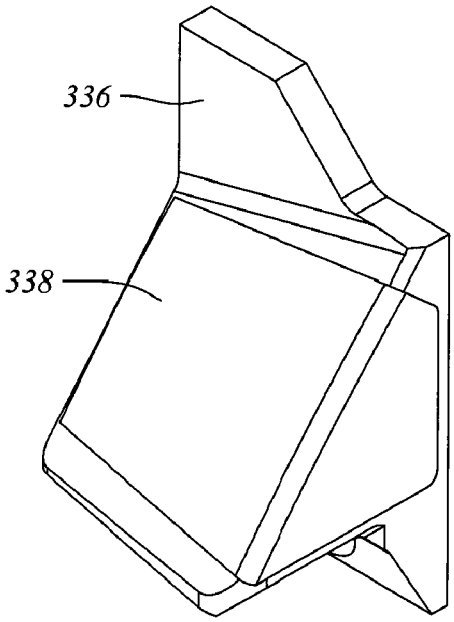
FIG. 3*h* shows an isometric view of a further alternate damper to that of FIG. 3*a*, having a "wrap-around" friction modifying pad.
Figure 3G:
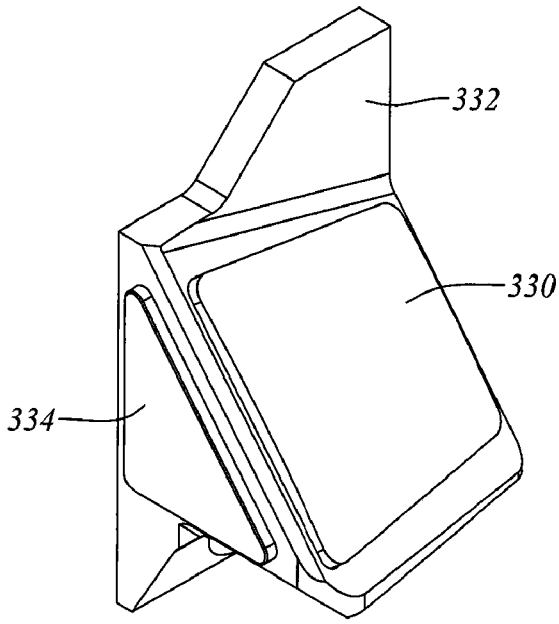
FIG. 3*g* shows an isometric view of an alternate damper to that of FIG. 3*a* having a friction modifying side face pad.
Figure 3A:
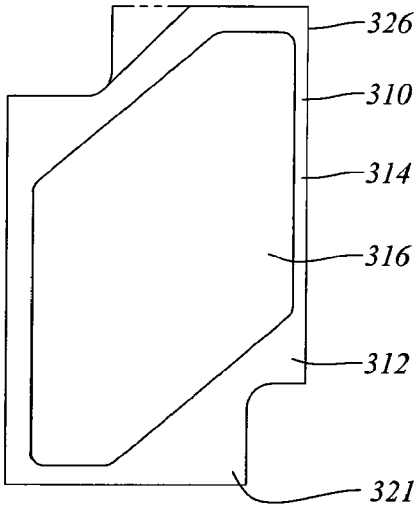
FIG. 3*a* is a front view of a friction damper for a truck such as that of FIG. 1*a;*
Figure 3F:
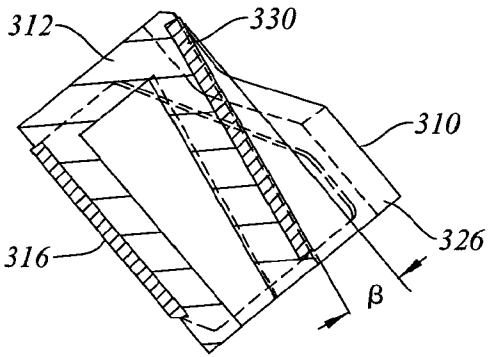
FIG. 3*f* is a section of the damper of FIG. 3*a* taken on section '3*f*-3*f*' of FIG. 3*e;*
Figure 3B:
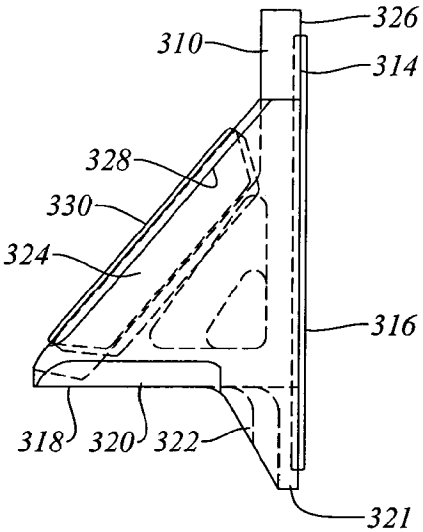
FIG. 3*b* shows a side view of the damper of FIG. 3*a;*
Figure 3E:
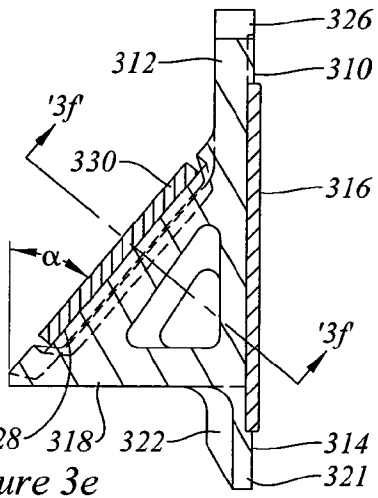
FIG. 3*e* shows a cross-sectional view on the centerline of the damper of FIG. 3*a* taken on section '3*e*-3*e*' of FIG. 3*c;*
Figure 3C:
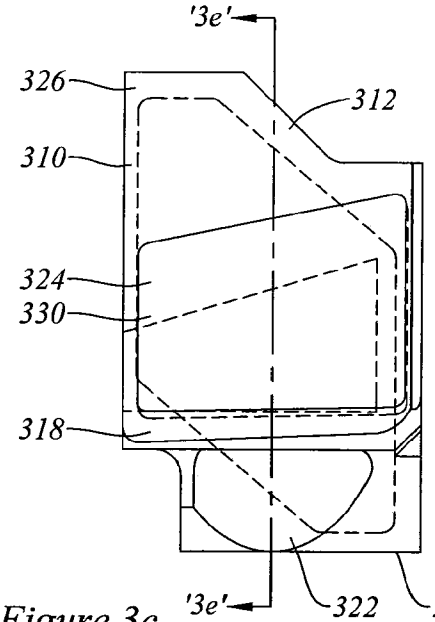
FIG. 3*c* shows a rear view of the damper of FIG. 3*b;*
Figure 3D:
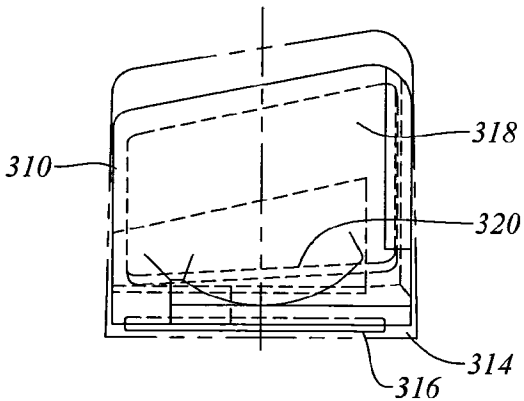
FIG. 3*d* shows a top view of the damper of FIG. 3*a;*
Figure 6A:
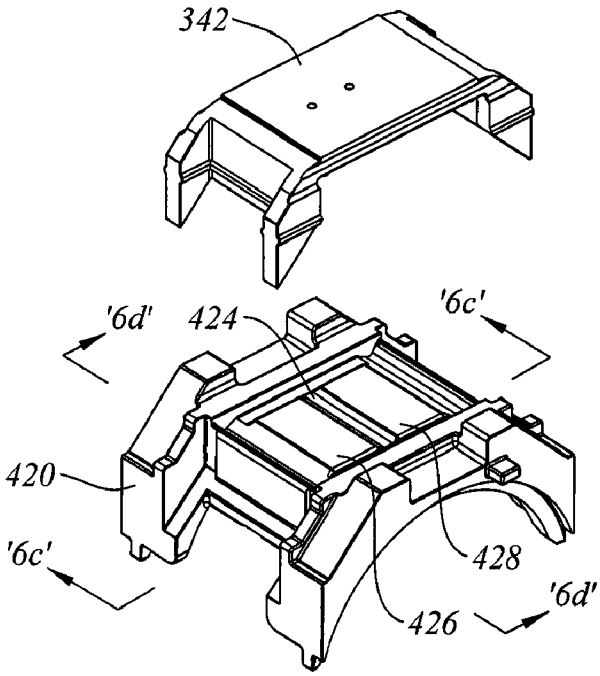
FIG. 6*a* is an exploded isometric view from above, in front, and to one side of an alternate bearing adapter and pad assembly to that of FIG. 4*a;*
Figure 6B:
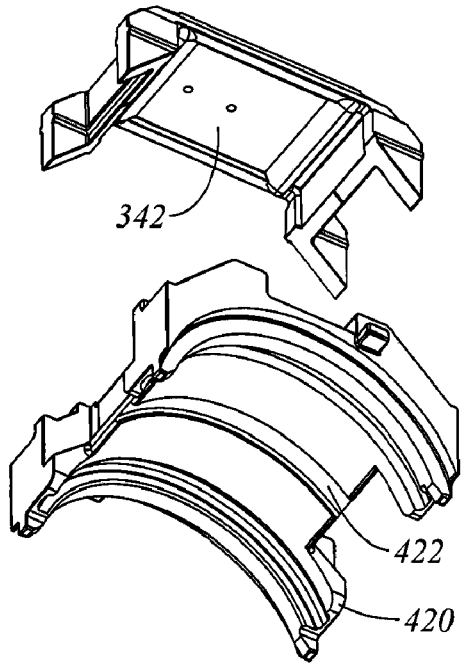
FIG. 6*b* shows an underside isometric view of the assembly of FIG. 6*a;*
Figure 6C:
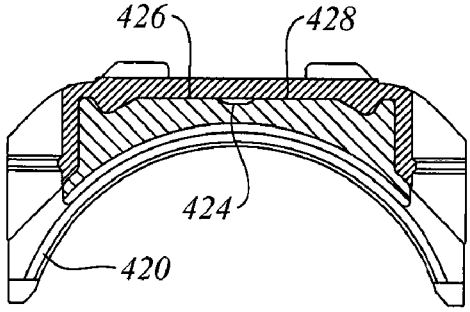
FIG. 6*c* shows a longitudinal cross section on the central plane of symmetry of the assembly of FIG. 6*a*, as assembled taken on section '6*c*-6*c*' of FIG. 6*a;*
Figure 6D:
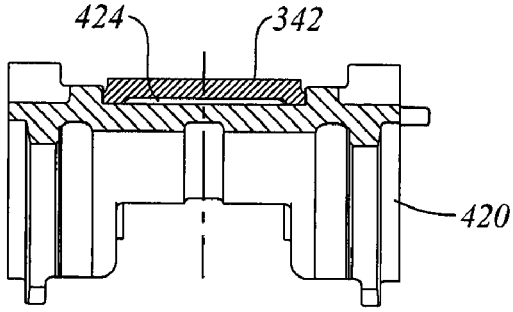
FIG. 6*d* is a longitudinal section on the central plane of symmetry of the bearing adapter and pad of FIG. 6*a*, as assembled, taken on section '6*d*-6*d*' of FIG. 6*a;*
Figure 7A:
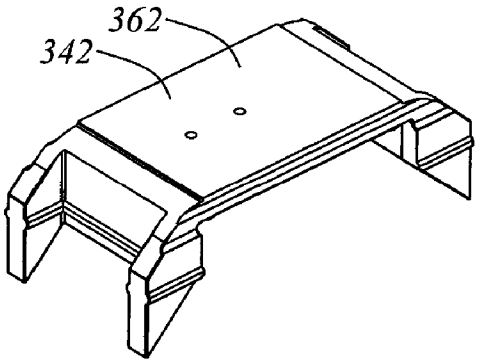
FIG. 7*a* shows a top view of alternate bearing adapter to that of FIG. 6*a* having a pair of reliefs formed in a central region of the upper portion thereof.
Figure 7A:
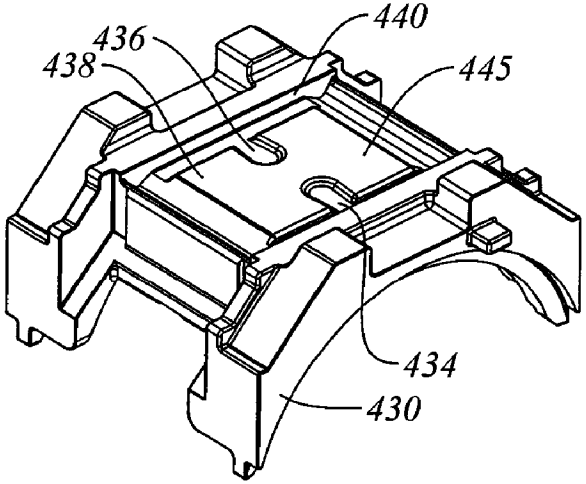
Figure 7B:
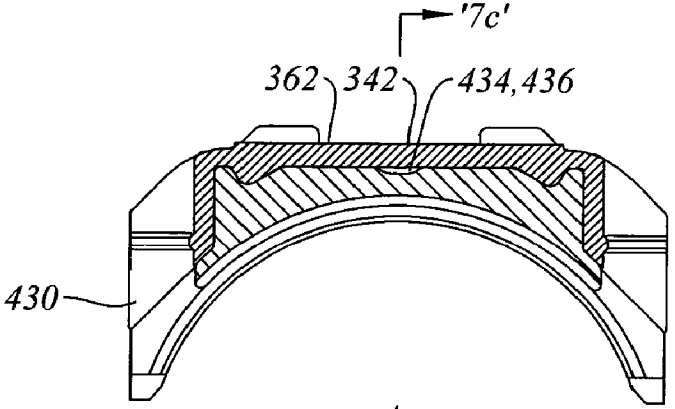
FIG. 7*b* shows a longitudinal cross-sectional view of the bearing adapter of FIG. 7*a* taken on section '7*b*-7*b*' through on of the reliefs as indicated in FIG. 7*c;*
Figure 7C:
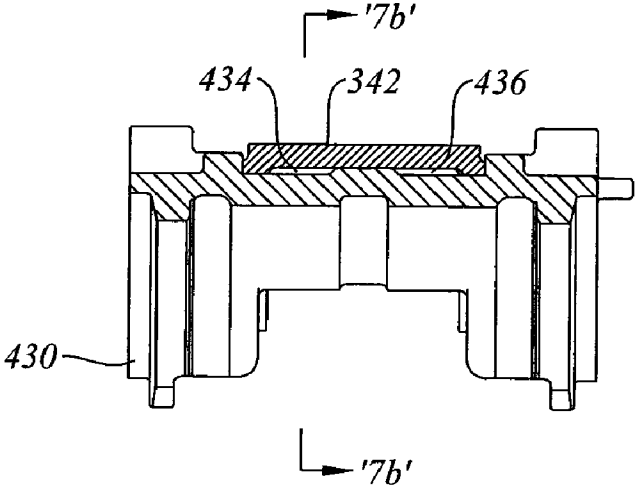
FIG. 7*c* shows a lateral cross-sectional view on the central plane of symmetry of the bearing adapter of FIG. 7*a*, indicated as section '7*c*-7*c*' in FIG. 7*b;*

In the alternative embodiment of FIG. 3*g*, a damper wedge 332 is similar to damper wedge 310, but, in addition to pads or inserts for providing modified or controlled friction properties on the friction face for engaging the sideframe column and on the face for engaging the slope of the bolster pocket, damper wedge 332 may have pads or inserts such as pad 334 on the side faces of the wedge for engaging the side faces of the bolster pockets. In this regard, it may be desirable for pad 334 to have low coefficients of friction, and to tend to be free of stick slip behaviour. The friction materials may be cast or bonded in place, and may include mechanical interlocking features, such as shown in FIG. 6*a*, or bosses, grooves, splines, or the like such as may be used for the same purpose. Similarly, in the alternative embodiment of FIG. 3*h*, a damper wedge 336 is provided in which the slope face insert or pad, and the side wall insert or pad form a continuous, or monolithic, element, indicated as 338. The material of the pad or insert may, again, be cast in place, and may include mechanical interlock features.

In this embodiment, vertical face 268 (FIG. 1*e*) of friction damper 264, 266 (FIG. 1*e*) may have a bearing surface having a co-efficient of static friction, $\mu_s$, and a co-efficient of dynamic or kinetic friction, $\mu_k$, that may tend to exhibit little or no "stick-slip" behaviour when operating against the wear surface of wear plate 270 (FIG. 1*e*). In one embodiment, the coefficients of friction are within 10% of each other. In another embodiment the coefficients of friction are substantially equal and may be substantially free of stick-slip behaviour. In one embodiment, when dry, the coefficients of friction may be in the range of 0.10 to 0.45, may be in the narrower range of 0.15 to 0.35, and may be about 0.30. Friction damper 264, 266 may have a friction face coating, or bonded pad 286 (FIG. 1*e*) having these friction properties, and corresponding to those inserts or pads described in the context of FIGS. 3*a*-3*h*. Bonded pad 286 may be a polymeric pad or coating. A low friction, or controlled friction pad or coating 288 (FIG. 1*e*) may also be employed on the sloped surface of the damper. In one embodiment that coating or pad 288 may have coefficients of static and dynamic friction that are within 20%, or, more narrowly, 10% of each other. In another embodiment, the coefficients of static and dynamic friction are substantially equal. The co-efficient of dynamic friction may be in the range of 0.10 to 0.30, and may be about 0.20.

FIGS. 4*a*-4*f*

Figure 4A:
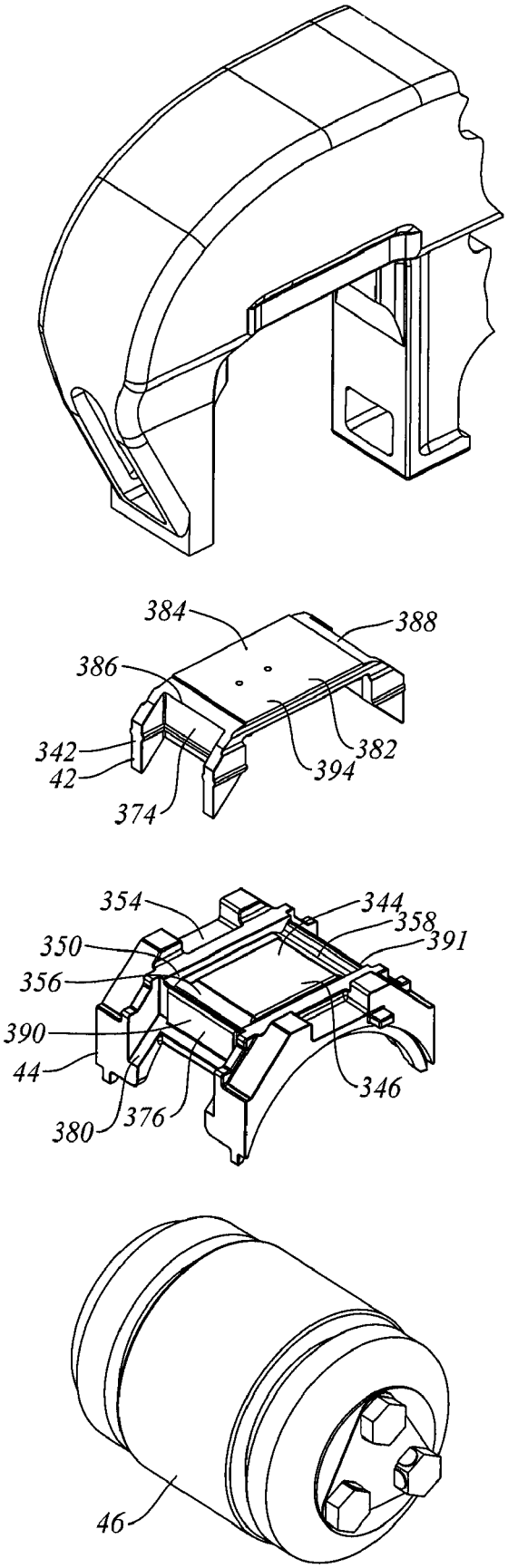
FIG. 4*a* is an exploded isometric view from above, in front, and to one side of a bearing, bearing adapter and elastomeric pad assembly for use in the truck of FIG. 1*a;*

FIG. 4*a* shows an arrangement of bearing to sideframe interface assembly that may be employed in the trucks of FIGS. 1*a* and 1*e*. In the wheelset to sideframe interface assembly of FIG. 4*a*, a bearing adapter 44 may be employed with a fitting such as resilient member 42 that may be in the nature of an elastomeric pad identified as resilient member 342, such as may be a "Pennsy pad". The term "Pennsy pad", or "Pennsy Adapter Plus", refers to a kind of elastomeric pad developed by Pennsy Corporation of Westchester Pa. One example of such a pad is illustrated in U.S. Pat. No. 5,562,045 of Rudibaugh et al., issued Oct. 6, 1996 (and which is incorporated herein by reference). Bearing adapter 44 may have an upper surface 344 that provides a cradle, or seat, for pad 342. The upper portion of bearing adapter 44 may include a central bed portion 346. Bed portion 346 may lie between a pair of lateral indexing features, such as may be in the nature of longitudinally extending channels, or grooves or depressions, 348, 350. A pair of raised, longitudinally extending lateral retainer members, or lateral abutment walls, or side walls 352, 354 may stand upwardly of channels 348 and 350, and may thereby bracket both channels 348, 350 and bed portion 346. At either longitudinal end of bed 346 there may be longitudinal indexing or retainer fittings, such as may be in the nature of laterally extending depressions 356, 358.

Pad 342 may have a lower surface 360, that is formed to engage the top of the bearing adapter in a manner inhibit migration or displacement of pad 342 relative to the bearing adapter. For example, pad 342 may have the negative image of bed 346, with lateral indexing members, such as may be in the nature of longitudinally extending rails, or feet, 362, 364 that seat in mating engagement in channels 348 and 350 in close fitting location between sidewalls 352, 354, and which may tend to bound lateral deflection or migration of pad 342. Pad 342 may also have longitudinal indexing, or keying, or retaining features such as may be in the nature of blisters, or bulges, 366, 368 that seat in mating engagement in depressions 356, 358 and may tend to inhibit longitudinal migration of pad 342 relative to bearing adapter 44. Pad 342 may also have, at its end regions, depending legs, or feet, 370, 372 and end wall members, such as may be identified as skirts 374, such as may extend laterally between feet 370 and 372 and which, when installed, may depend downwardly over a portion, or all of, end walls 376 of bearing adapter 44. Bearing adapter 44 may have a three sided shelf or ridge, 380 running about the inside of legs 370, 372 and wall 376 in a manner to which the depending toes of feet 370, 372 and lower edge of skirt 374 may conform. Pad 342 may also include an upper surface, 382, for mating engagement with the pedestal seat fitting, such as may be a wear liner seated in the pedestal roof, or the pedestal roof, as may be.

Pad 342 may be a single resilient member 384, such as may be a monolithic cast material, be it polyurethane or a suitable rubber or rubberlike material such as may be used, for example, in making an LC pad or a Pennsy pad. An LC pad is an elastomeric bearing adapter pad available from Lord Corporation of Erie Pa. An example of an LC pad may be identified as Standard Car Truck Part Number SCT 5578. In this instance, resilient member 384 has first and second end portions 386, 388 for interposition between the thrust lugs of the jaws of the pedestal and the ends 390 and 391 of the bearing adapter. End portions 386, 388 may tend to be a bit undersize so that they may slide vertically into place on the thrust lugs, possibly in a modest interference fit. The bearing adapter may slide into place thereafter, and again, may do so in a slight interference fit.

The pad, namely resilient member 342 may also have a central or medial portion 394 extending between end portions 386, 388. Medial portion 394 may extend generally horizontally inward to overlie substantial portions, if not substantially all, of the upper surface bearing adapter 44. In one embodiment the resilient member 342 may be formed in the manner of a Pennsy Pad. FIG. 4*a* shows an installation thereof. The Pennsy pad may tend to permit a measure of passive steering. The Pennsy pad installation of FIGS. 4*a*-4*d* may be installed in the sideframe of FIG. 1*a*, in combination with a four cornered damper arrangement, as indicated in FIGS. 1*a*-1*d* or in the single damper arrangement of FIG. 1*e*. For example, in one embodiment, the truck of FIG. 1*e* may be taken as being a Barber S2HD truck. In another embodiment, the truck of FIG. 1*a* may be taken to be a Barber S2HD truck modified to carry a four-cornered damper arrangement, as described above.

In the embodiments described herein, the resilient member, which may be an elastomer, and may be a man made polymer having an elastic response, is assumed to be in extensive surface contact with both an underlying member, in the nature of the interface with the underlying bearing adapter, and in extensive surface contact with an overlying member, such as a pedestal seat, or, in some instances, with the pedestal roof itself where no intermediate member is employed. In each case the resilient member is understood to be squeezed bodily between these two interfaces, and to transmit the vertical load imposed during normal operation. That is, the resilient member is expected to transmit a vertical load that is imposed in a direction through the thickness of the material.

In this example, and in the other examples discussed below, the gap formed (or, in some examples below, the non-homogenous vertical response created by having regions of different vertical stiffness) may tend to yield a vertical load path discontinuity. This vertical load path discontinuity may tend to cause the vertical loads from the sideframe pedestal to be passed into the bearing in a manner in which the vertical load is shed, or shared, laterally to a greater extent than might be the case but for that discontinuity. This load shedding, or sharing, to either side of top dead center of the bearing races may tend to increase roller loading away from top dead center, and reduce, or moderate it at top dead center. The extent to which this load shedding or load sharing may occur may be greater, or lesser depending on the geometry chosen. It may be that the geometry is chosen to maintain a gap at all times, including under the most extreme vertical design load. Alternatively, it may be chosen to maintain a gap at the mean loading of the bearing races when the truck is carrying its full rated load, be it half a 263,000 lb car, half a 286,000 lb car or half a 315,000 lb car. Alternatively, it may be chosen to maintain a gap at the mean loading plus one, two or three standard deviations from the mean loading, based on recorded load histories. This type of bearing adapter and pad arrangement, or the other embodiments described hereinbelow is not necessarily limited to four wheeled trucks, such as three piece freight car trucks, for example, but may also be used in a six wheeled truck or an eight wheeled truck, or other truck.

FIGS. 4*c*-4*f*

Figure 4B:
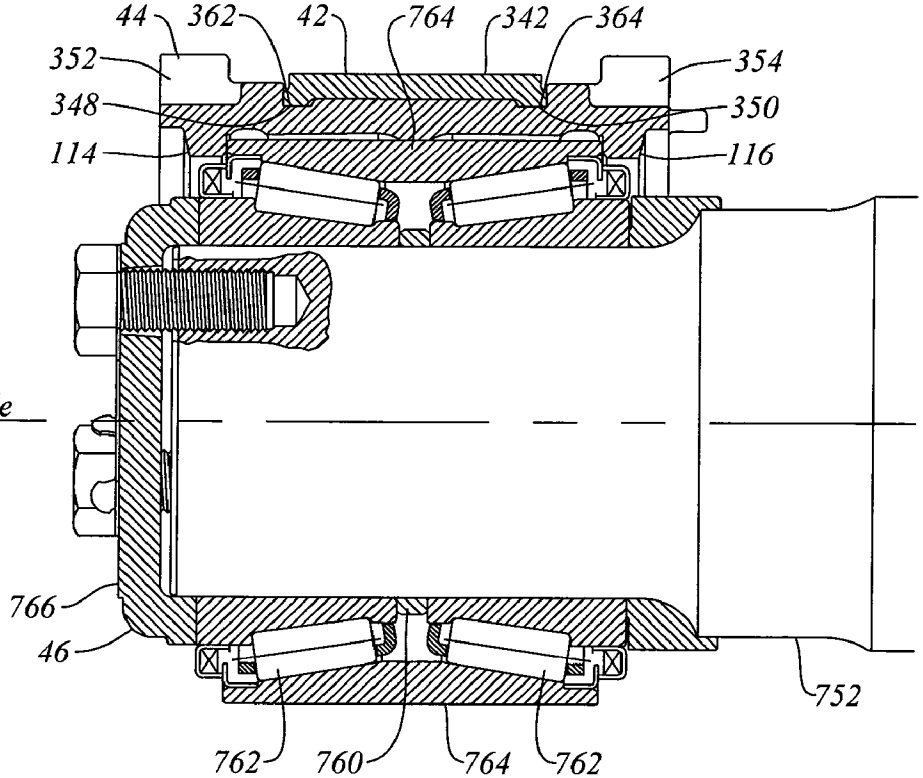
FIG. 4*b* shows a cross section of the assembly of FIG. 4*a*, as assembled, taken in the vertical plane of the longitudinal axis of the bearing.
Figure 4C:
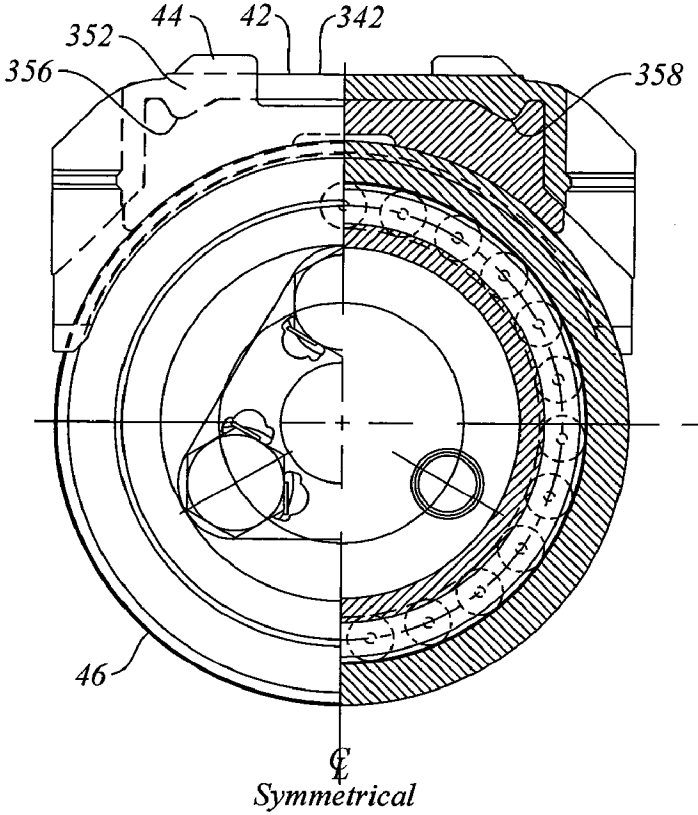
FIG. 4*c* is a half end view, half section view of the assembly of FIG. 4*a*, as viewed looking along the long axis of the bearing, the half section being a view on section '4*c*-4*c*' of FIG. 4*b;*
Figure 4D:
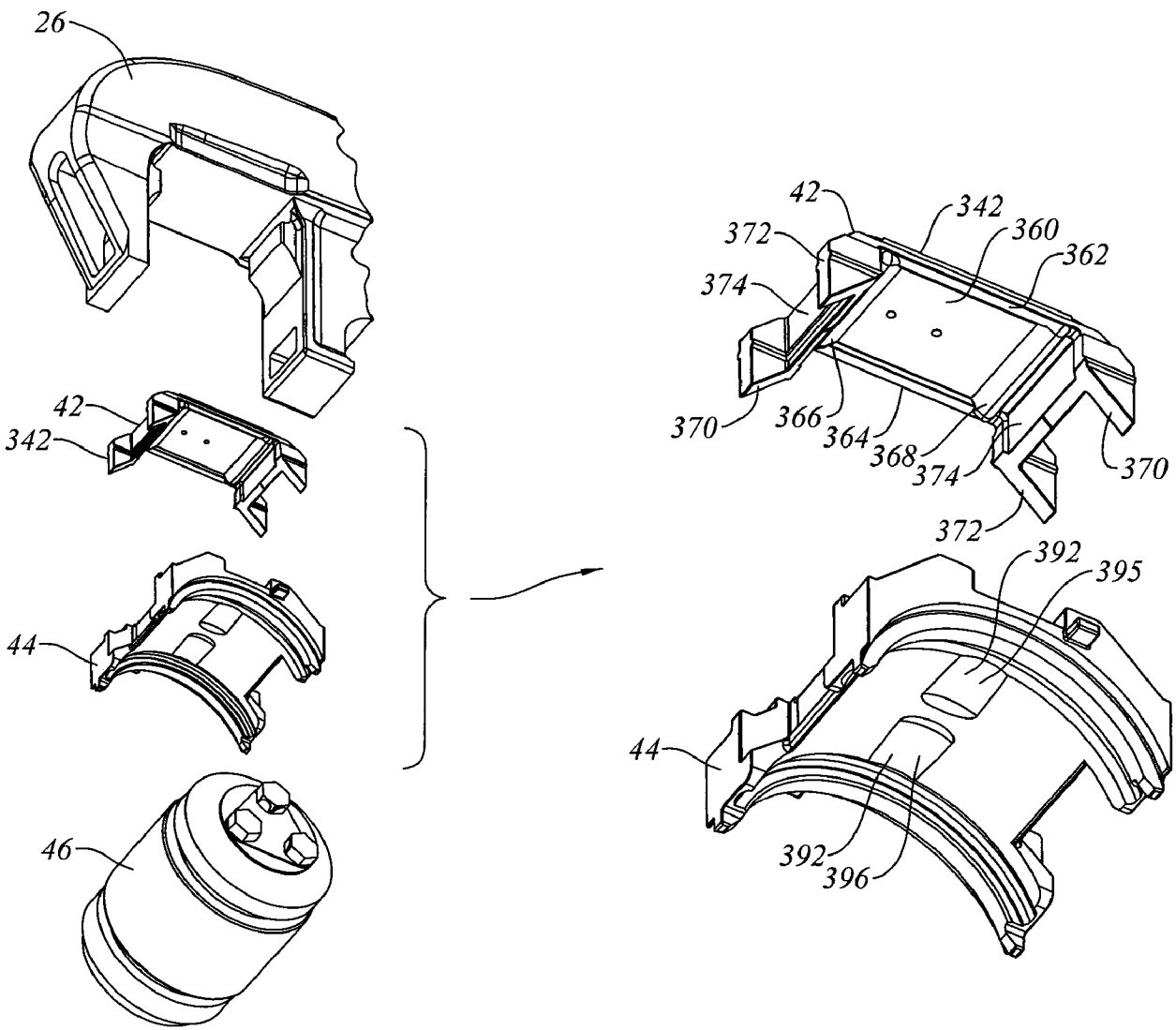
FIG. 4*d* is an underside isometric view of the bearing adapter and pad of FIG. 4*a;*

The illustrations of FIGS. 4*b* and 4*c* include illustrations of bearing 46 that are based on the bearing cross-section illustration shown on page 812 of the 1997 *Car and Locomotive Cyclopedia*. That illustration was provided to the Cyclopedia courtesy of Brenco Inc., of Petersburg, Va. Bearing 46 may be an assembly of parts including an inner ring 760, a pair of tapered roller assemblies 762 whose inner ring engages axle 752, and an outer ring member 764 whose inner frustoconical bearing surfaces engage the rollers of assemblies 762. The entire assembly, including seals, spacers, and backing ring may be held in place by an end cap 766 mounted to the end of axle 752. FIGS. 4*b* and 4*c* are provided, in part, to illustrate the location of the bearing adapter arches 114, 116, relative to the bearing casing or outer ring member 764, those arches lying in generally parallel planes and being spaced in the axial direction of the bearing sufficiently far apart to bracket the casing, such that the body of the bearing adapter, namely the central portion between the two arches, overspans, and brackets or straddles, the bearing races. That is, the bearing races lie axially between the two end arches. As can be seen in the end cross-section, the apex of the arches, and the center, or central portion, of the body of the bearing adapter, in the centered, at-rest position, may tend to lie directly above the uppermost rollers of the bearing races.

Figure 4F:
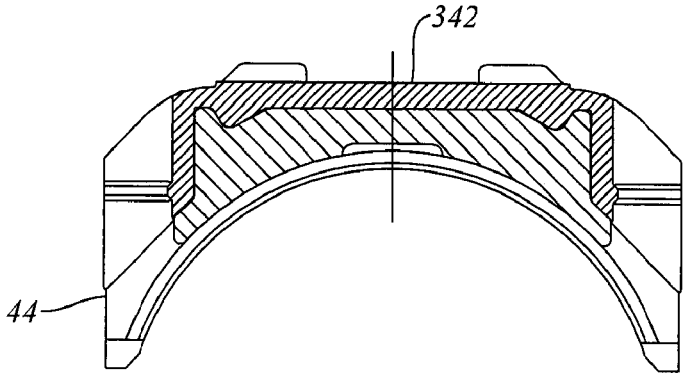
FIG. 4*f* is a longitudinal section of the bearing adapter and elastomeric pad of FIG. 4*e* taken on section '4*f*-4*f*' of FIG. 4*e;*
Figure 4G:
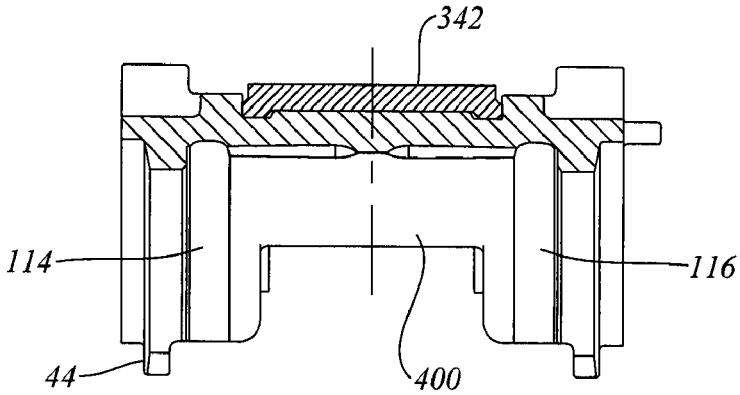
FIG. 4*g* is a lateral section of the bearing adapter and elastomeric pad of FIG. 4*e* taken on the central plane of symmetry, indicated as '4*g*-4*g*' in FIG. 4*e;*
Figure 4E:
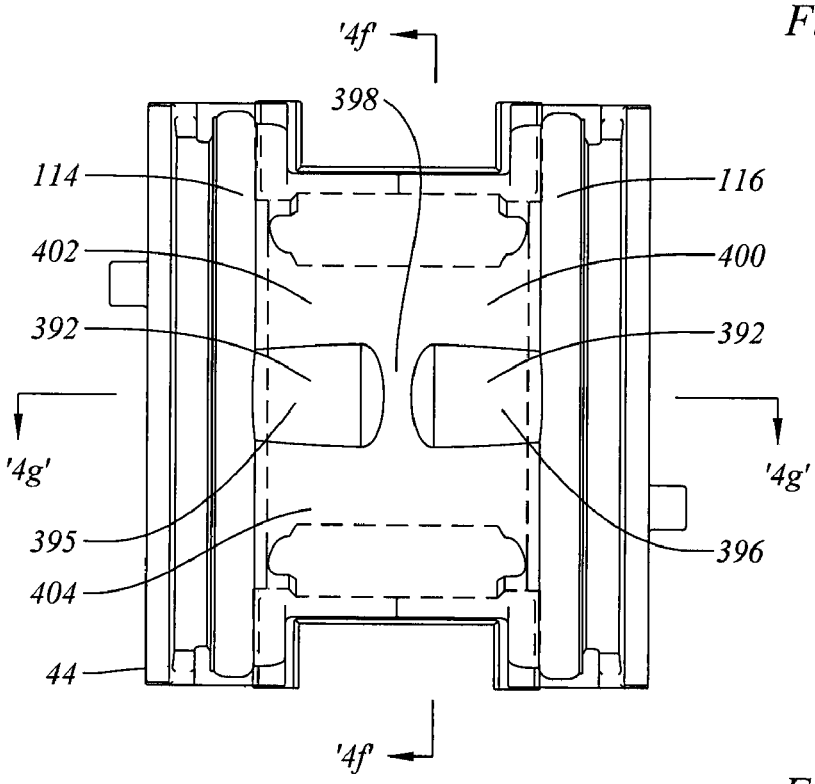
FIG. 4*e* is a bottom view of the bearing adapter and elastomeric pad of FIG. 4*a;*

FIGS. 4*e*-4*g*

FIGS. 4*e*-4*g* show views of bearing adapter 44, having underside grooving, 392 in the nature of a pair of laterally extending tapered lobate depressions, cavities, rebates, or reliefs 395, 396 separated by a central bridge region 398 having a deeper section and flanks that taper into reliefs 395, 396. Reliefs 395, 396 may have a major axis that runs laterally with respect to the bearing adapter itself, but, as installed, runs axially with respect to the axis of rotation of the underlying bearing. This major axis may lie at the apex of the under side of bearing adapter 44, parallel to the axis of rotation of bearing 46. The absence of material at reliefs 395, 396 may tend to leave a generally H-shaped footprint on the circumferential surface 400 that seats upon the outside of bearing 46, in which the two side regions, or legs, of the H form lands or pads 402, 404 joined by a relatively narrow waist, namely bridge region 398. To the extent that the undersurface of the lower portion of bearing adapter 44 conforms to an arcuate profile, such as may accommodate the bearing casing, reliefs 395, 396 may tend to run, or extend, predominantly along the apex of the profile, between the pads, or lands, that lie to either side. This configuration may tend to spread the sideframe pedestal load into pads 402, 404 and thence into bearing 46. By leaving a space between the underside of the bearing adapter and the top center of the bearing casing over the bearing races, reliefs 395, 396 may tend to prevent the vertical load being passed in a concentrated manner predominantly into the top rollers in the bearing. Instead, it may perhaps tend to be spread between several rollers in each race somewhat more or less evenly, than might otherwise be the case. Central bridge region 398 may seat above a section of the bearing casing under which there is no race, rather than directly over one of the races. Conversely, reliefs 394, 396 may seat over top center position of the rollers in the bearing races, tending to cause the load to be passed into the bearing casing to either side of the top roller. It is thought that this may tend to encourage longer bearing life. The width of each of reliefs 394, 396 may be taken, on a circumferential arc measurement, to be wider than the width of a roller. Inasmuch as there may be roughly 23 rollers in the bearing, rebate 392, may be larger, or wider, than 15 degrees of arc as measured from the center of rotation of the bearing.

FIGS. 5*a*-5*d*

FIGS. 5*a*-5*d* show an alternate combination of a bearing adapter 410 and resilient member, or pad, 412 to that described above. Pad 412 may be identical to resilient member 342.

The underside of bearing adapter 410 may have a circumferentially extending medial groove, channel or rebate 414, having an apex lying on the transverse plane of symmetry of bearing adapter 410, but also a laterally extending underside groove, channel, slot or rebate 416 such as may tend to lie parallel to the underlying longitudinal axis of the wheelset shaft and bearing centreline (i.e., the axial direction) such that the underside of bearing adapter 410 has four corner lands or pads 418 arranged in an array for seating on the casing of the bearing. In this instance, each of the pads, or lands, may be formed on a curved surface having a radius conforming to a body of revolution such as the outer casing of the bearing. Rebate 416 may tend to lie along the apex of the arch of the underside of bearing adapter 410. Rebates 414 and 416 may intersect as shown, form a cross. Rebate 416 may be relatively the shallower, and may be gently radiused into the surrounding bearing adapter body. The body of bearing adapter 410 is more or less symmetrical about both its longitudinal central vertical plane (i.e., on installation, that plane lying vertical and parallel to, if not coincident with, the longitudinal vertical central plane of the sideframe), and also about its transverse central plane (i.e., on installation, that plane extending vertically radially from the center line of the axis of rotation of the bearing and of the wheelset shaft). It may be noted that axial rebate 416 may tend to lie at the section of minimum cross-sectional area of bearing adapter 410. Rebates 414 and 416 may tend to divide, and spread, the vertical load carried through the rocker element over a larger area of the casing of the bearing, and hence more evenly to distribute the load into the rollers of the bearing than might otherwise be the case. As before in one embodiment, the width of rebate 416 may correspond roughly to the width of one roller.

FIGS. 6*a*-6*d*

Figure 5A:
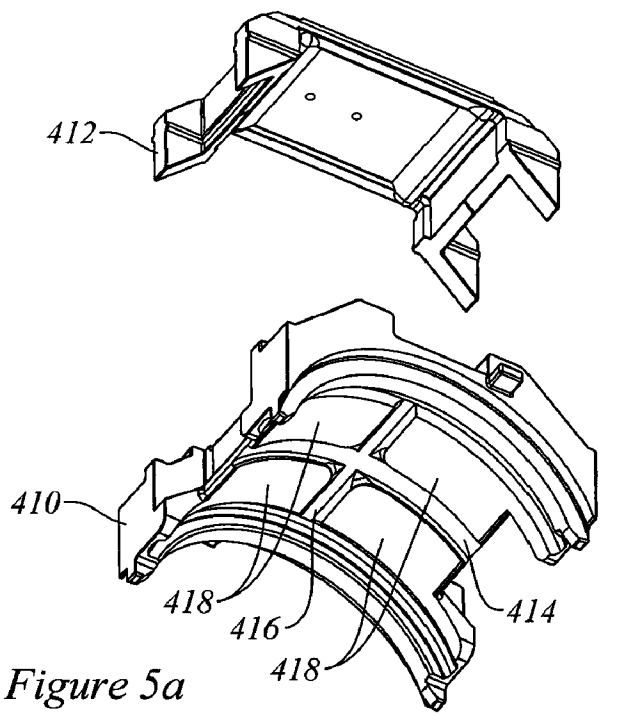
FIG. 5*a* shows an exploded underside isometric view of an alternate combination of bearing adapter and elastomeric pad to that of the assembly of FIG. 4*a;*
Figure 5C:
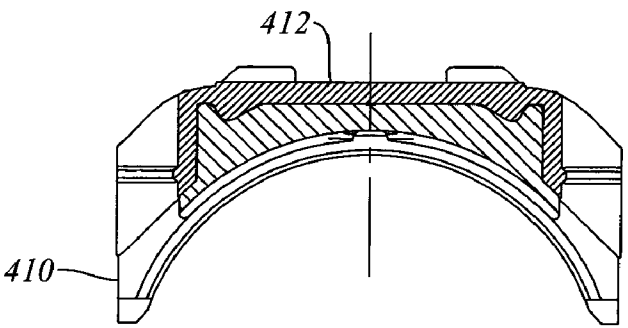
FIG. 5*c* shows a longitudinal cross-section of the bearing adapter and elastomeric pad of FIG. 5*a*, as assembled, taken on the central, longitudinal axis of symmetry indicated as '5*c*-5*c*' in FIG. 5*b;*
Figure 5D:
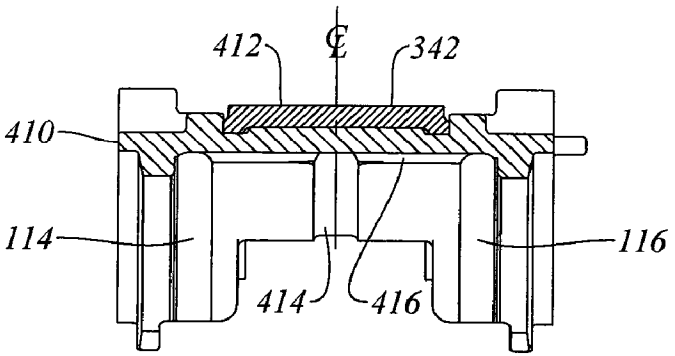
FIG. 5*d* shows a lateral cross-section of the bearing adapter and elastomeric pad of FIG. 5*a*, as assembled, taken on the central lateral plane of symmetry, indicated as '5*d*-5*d*' in FIG. 5*b;*
Figure 5B:
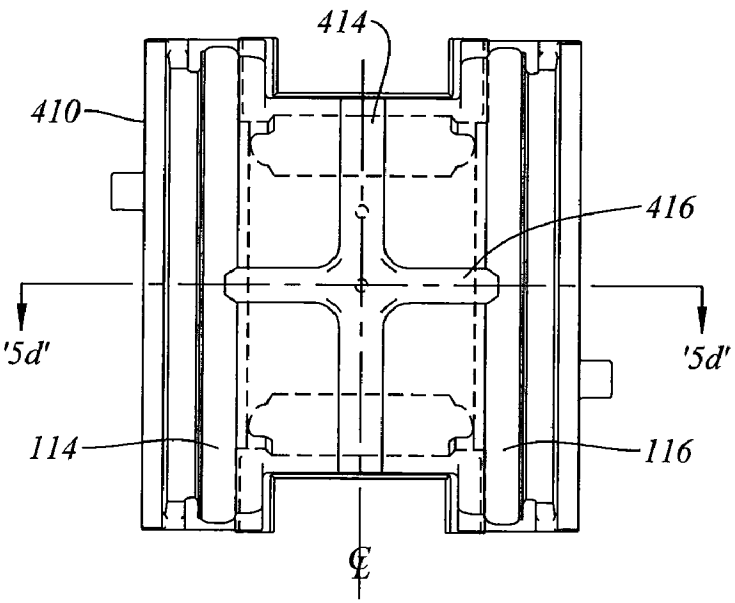
FIG. 5*b* shows a bottom view of the bearing adapter and elastomeric pad of FIG. 5*a;*

FIGS. 6*a* to 6*d* show an alternate combination of bearing adapter and resilient pad member to that of FIG. 4*a* or 5*a*. In FIG. 6*a*, a bearing adapter is identified as 420. The resilient pad may be taken as being the same as resilient member 342 described above.

Bearing adapter 420 may have a circumferentially extending groove 422 formed therein, which may be generally similar to rebate 414 of bearing adapter 410. However, rather than having an underside lateral groove, bearing adapter 420 may have a topside that is the same as, or substantially similar to that of bearing adapter 44, except insofar as it has a lateral relief, groove, slot, rebate or channel 424 that may be centered over, and may run parallel to, the axis of rotation of bearing 46. Channel 424 may tend to separate the upper surface of the bed of bearing adapter 420 into two regions 426 and 428. The transition from regions 426 and 428 into channel 424 may be on relatively large radii, and the walls of channel 424 may be inclined, or chamfered as well. In one embodiment, the depth of channel 424 may be of the order of ⅓ to ⅛ of its overall width. The width of channel 424 may correspond to about the arc of one roller of the underlying bearing 46. In other respects, the upper surface of bearing adapter 420 may be substantially the same as bearing adapter 44. When a vertical load is passed from the pedestal seat or pedestal roof (as may be) into the resilient member 342, it may tend to be compressed against regions 426 and 428, and less compressed (if compressed at all) over channel 424, such that the load may pass into bearing adapter 420 to either side of the top central position.

FIGS. 7*a*-7*d*

In FIGS. 7*a*-7*d*, there is a bearing adapter 430, and a resilient pad which may be taken as being the same as resilient member 342. Bearing adapter 430 may be taken as being the same as bearing adapter 420 except insofar as bearing adapter 430 may employ cusp shaped reliefs or rebates 434, 436, in place of a full lateral slot, such as channel 424. Rebates 434, 436 may have the same general shape in plan view as the underside reliefs shown in FIGS. 4*a*-4*d*. Rebates 434, 436 may be gently merged into the surrounding structure, as by having angled or chamfered walls that are smoothly radiused into top surface portion 438 and into the adjacent longitudinally extending grooves or channels, 440. In one embodiment, the size of rebates 434, 436 may correspond to the size of one roller of the underlying bearing 46, and may, at their greatest width, subtend about 15-20 degrees of arc as measured from the center of rotation of bearing 46. Alternately, in one embodiment, the dimension of the largest width of rebate 434-436 measured perpendicular to the axis of bearing 46, may be in the range of about ½ to 1 inch. When vertical loads are passed from the sideframe pedestal into resilient member 342 and then into bearing adapter 430, those loads may tend to be introduced to either side of the underlying central roller bearing position. That portion of resilient member 342 lying over rebates 434, 436 may tend not to be compressed vertically to the same extent (if at all) as the adjacent regions of resilient member 342 that may overlie the generally H-shaped upper table-like surface 445 of the bed of bearing adapter 430.

FIGS. 8*a*-8*d*

Figure 8A:
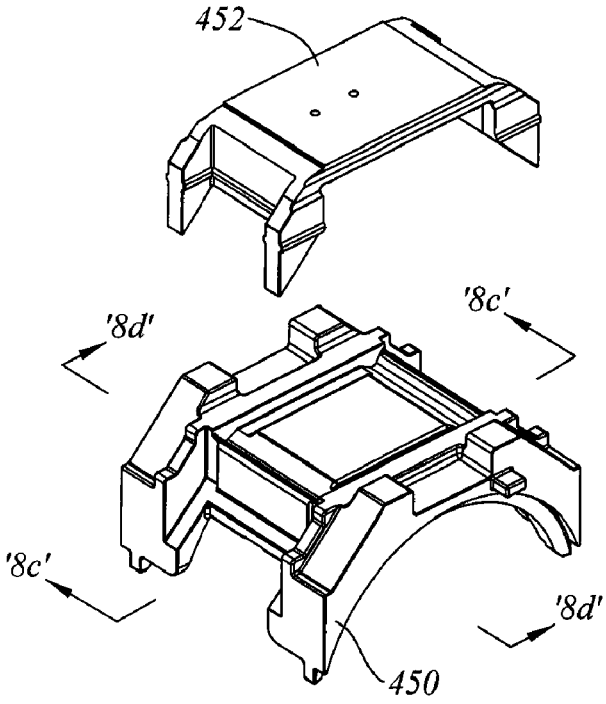
FIG. 8*a* shows an isometric exploded view, from above, of an alternate embodiment of bearing adapter and pad combination to that of FIG. 4*a* in which the underside of the pad has a laterally extending slot in a central region thereof.
Figure 8B:
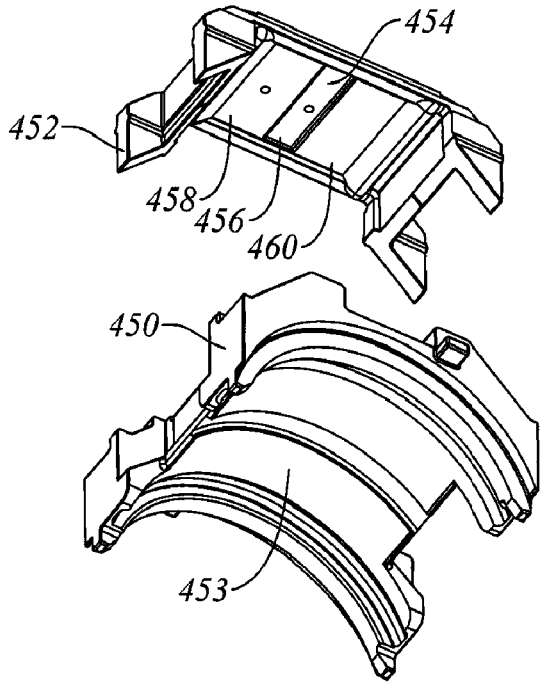
FIG. 8*b* shows an isometric view, from below, of the bearing adapter and pad combination of FIG. 8*a;*
Figure 8C:
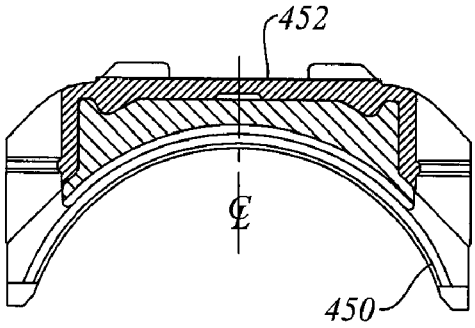
FIG. 8*c* shows a longitudinal cross-section of the bearing adapter pad of FIG. 8*b* viewed on the central plane of symmetry.
Figure 8D:
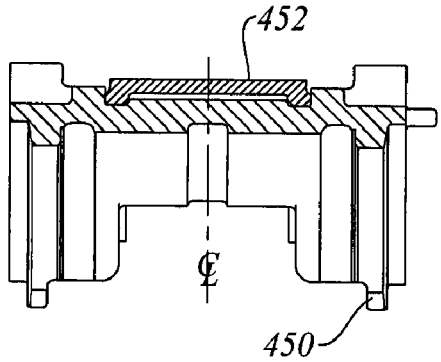
FIG. 8*d* shows a lateral cross-section of the bearing adapter pad of FIG. 8*b* as viewed on the central plane of symmetry.

In the embodiment of FIG. 8*a*, there may be a bearing adapter 450 and a resilient pad member 452. Bearing adapter 450 may have an underside 453, and therefore an underside interface with bearing 46, that is the same, or substantially the same as the underside of bearing adapter 430 or 420, which may include arches for bracketing the outer ring, or casing, of bearing 46 and a circumferentially extending groove as previously described herein. Bearing adapter 450 may also have an upper surface, or upper interface for mating with resilient pad member 452, that is substantially the same as the upper surface of bearing adapter 44 previously described.

Resilient member 452 may be substantially the same as, or similar to, resilient member 342, and may differ therefrom to the extent that the underside of resilient member 452 may have a laterally extending slot, relief, rebate or channel 454 that extends fully thereacross. Channel 454 may have inclined or chamfered flanks, and the flanks may be smoothly radiused into the back 456 of channel 454 and the adjacent lands 458 and 460 lying to either side thereof, and through which vertical loads may tend to be passed into the upwardly facing bed surface of bearing adapter 450.

Figure 8G:
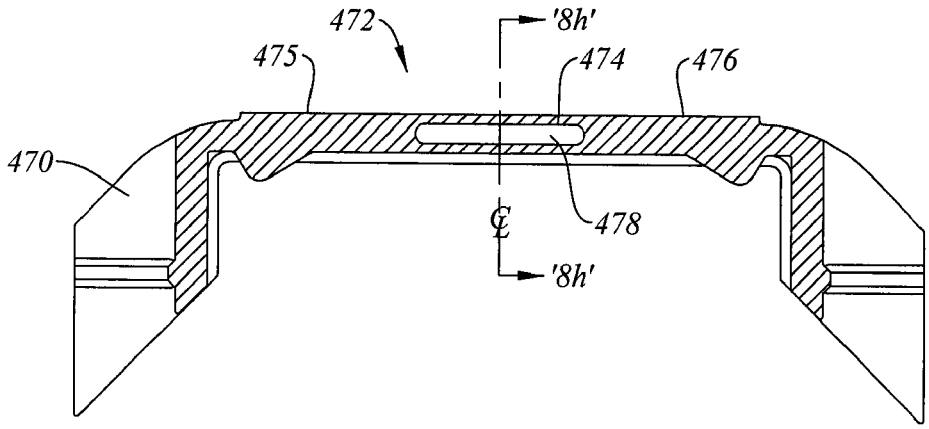
FIG. 8*g* shows a section on the longitudinal plane of symmetry of an alternate pad to that of FIG. 8*a* having an array of internal hollows within a central portion thereof.
Figure 8H:
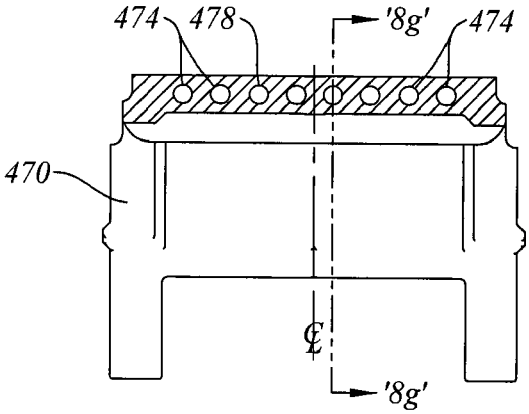
FIG. 8*h* shows a section on the lateral plane of symmetry of the pad of FIG. 8*g;*
Figure 8E:
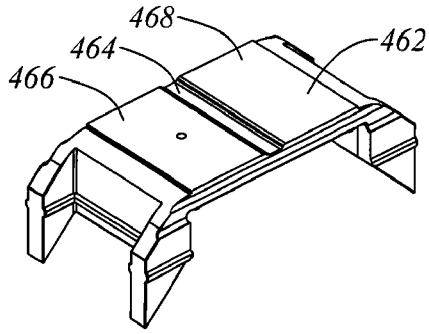
FIG. 8*e* is an isometric view, from above, of an alternate pad to that of FIG. 8*b* in which the top of the pad has a slot extending laterally across a central region thereof.
Figure 8E:
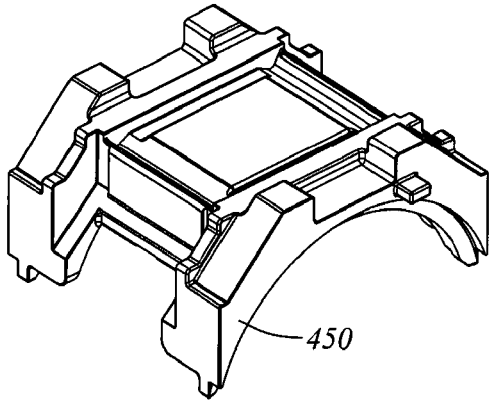
Figure 8F:
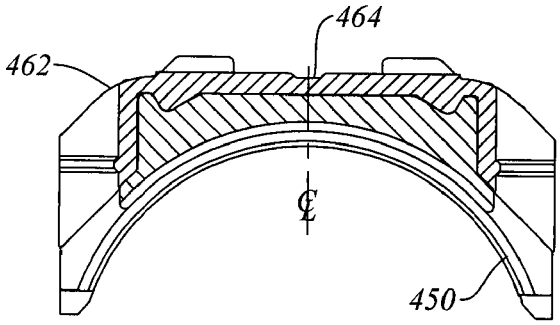
FIG. 8*f* shows a cross-section of the alternate pad of FIG. 8*e* taken on the longitudinal plane of symmetry thereof.

FIGS. 8*e* and 8*f*

In the embodiment of FIGS. 8*e* and 8*f*, bearing adapter 450 may be combined with a mating resilient member 462. Resilient member 462 may tend to be substantially the same as resilient member 452, but rather than having a channel in the downwardly facing surface, resilient member 452 may have a laterally extending channel 464 formed in the upwardly facing interface portion thereof, thereby dividing the upper surface into a pair of spaced apart land regions 466, 468 lying to either side of channel 464. The width of channel 464 may be similar to that of channel 454, and may correspond to the width of one roller of the underlying bearing. As with channel 454, channel 464 may have chamfered flanks, or sides, or slopes, and those slopes may be smoothly radiused into the back of the channel and into the adjoining interface regions 466, 468 that bear against the underside of the pedestal seat, or pedestal roof, as may be.

FIGS. 8*g* and 8*h*

In the embodiment of FIGS. 8*g* and 8*h*, bearing adapter 450 may be surmounted by a resilient member 470. Pad member 470 may have a central region 472 having formed within it internal features 474 of lesser stiffness than the body of the adjacent regions 475 and 476 lying to either side thereof. That is, the material of which resilient member 470 is made may have a bulk modulus of elasticity of some value. The bulk modulus of elasticity of the material of features 474 may be of some lesser value, such that, once a vertical displacement is imposed upon the upper surface 476 of resilient member 470, as might be done by a vertically loaded member whose stiffness is much greater than resilient member 470, such as a reinforced pedestal seat or pedestal roof, the mean force per unit area developed in central region 472 may be less, if not much less, than the corresponding mean force per unit area of the adjacent regions. For example, internal features 474 may be substantially completely gas, such as air or carbon dioxide. It may be that features 474 may have the form of blind bores 478 of circular section, extending some distance along resilient member 470, being centered on the lateral plane of symmetry of resilient member 470. It may be that the length of bores 478 may correspond roughly to one roller or underlying bearing 46, or perhaps as much as 1½ rollers. In one embodiment, features 474 are more highly concentrated over the axial position of the underlying bearing races.

Figure 8J:
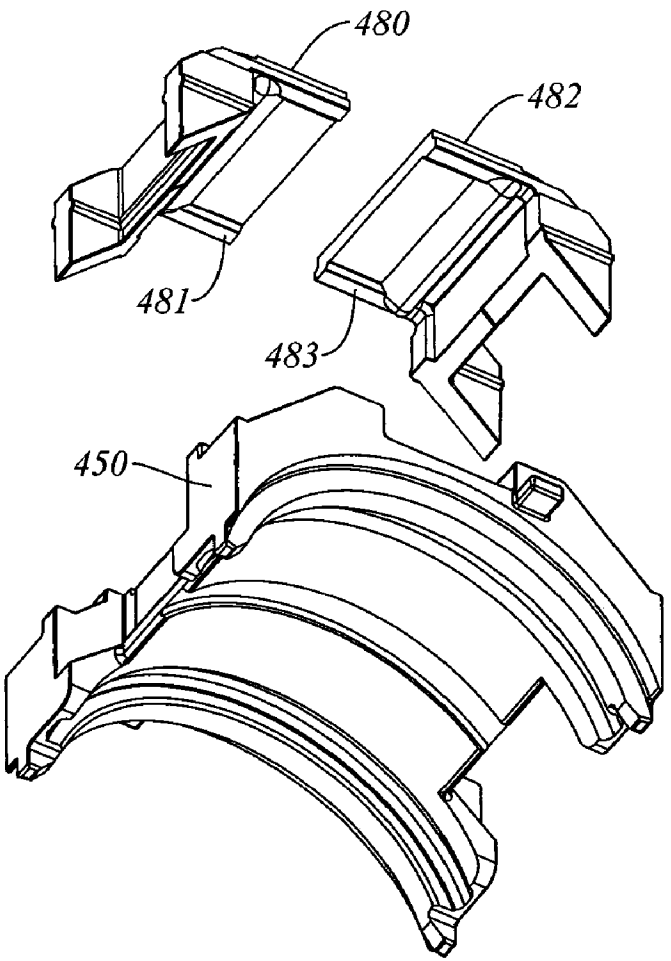
FIG. 8*j* shows an isometric view from below of the bearing adapter of FIG. 8*i;*
Figure 8I:
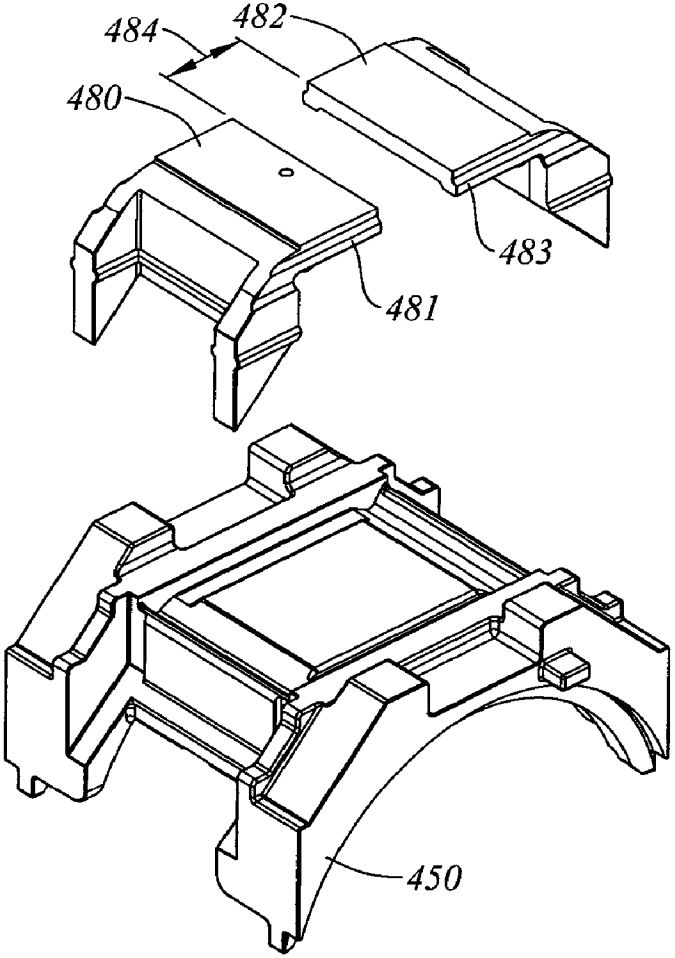
FIG. 8*i* shows an isometric view of an alternate bearing adapter and pad combination to that of FIG. 8*a*; employing a pair of pads having a central gap therebetween.

FIGS. 8*i* and 8*j*

In the embodiment of FIGS. 8*i* and 8*j*, bearing adapter 450 is surmounted by a pair of first and second resilient members 480, 482 that, taken together, are substantially the same as resilient member 342, except insofar as there is a gap 484 between them when installed. First and second resilient members 480, 482 may be equal in size, such that the resultant gap, 484 may tend to be centered over, and may have roughly the same circumferential extent as, a roller of underlying bearing 46. The substantially planar inwardly extending regions 481 and 483 of resilient members 480, 482, respectively, may, between them, overlay more than ⅔ of the substantially horizontal, upwardly facing surface of bearing adapter 450. They may overlay between half and 9/10 of that upwardly facing surface. In one embodiment each of regions 481 and 483 may overlie more than ⅓ of the upwardly facing surface, and less than 9/20 of that surface. In one embodiment they may each overlie between 35 and 45% of the surface.

Figure 9A:
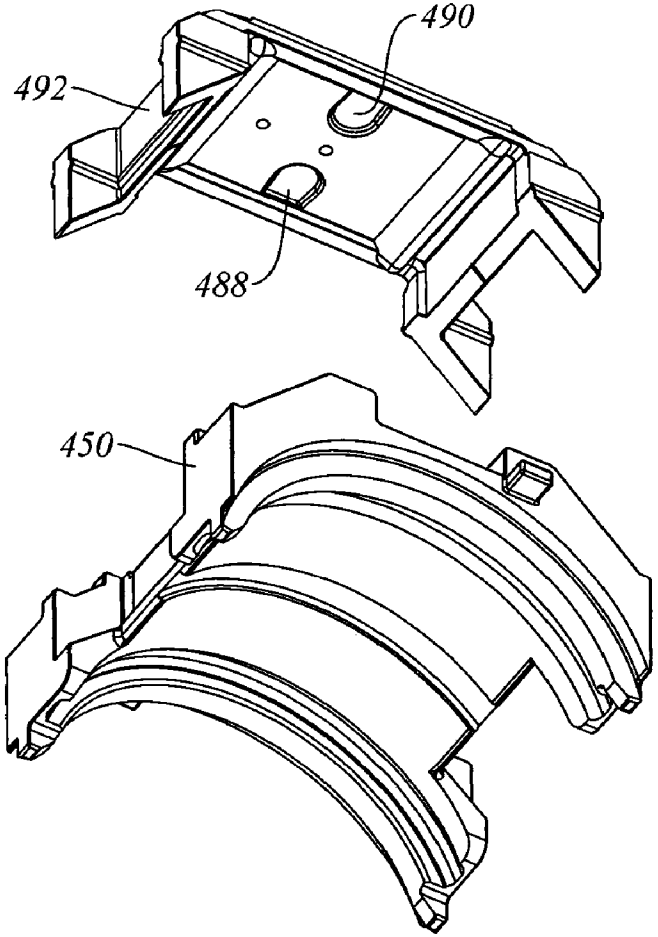
FIG. 9*a* shows an isometric underside view of an alternate pad and bearing adapter combination to that of FIG. 8*a*; in which the underside of the pad has reliefs.
Figure 9B:
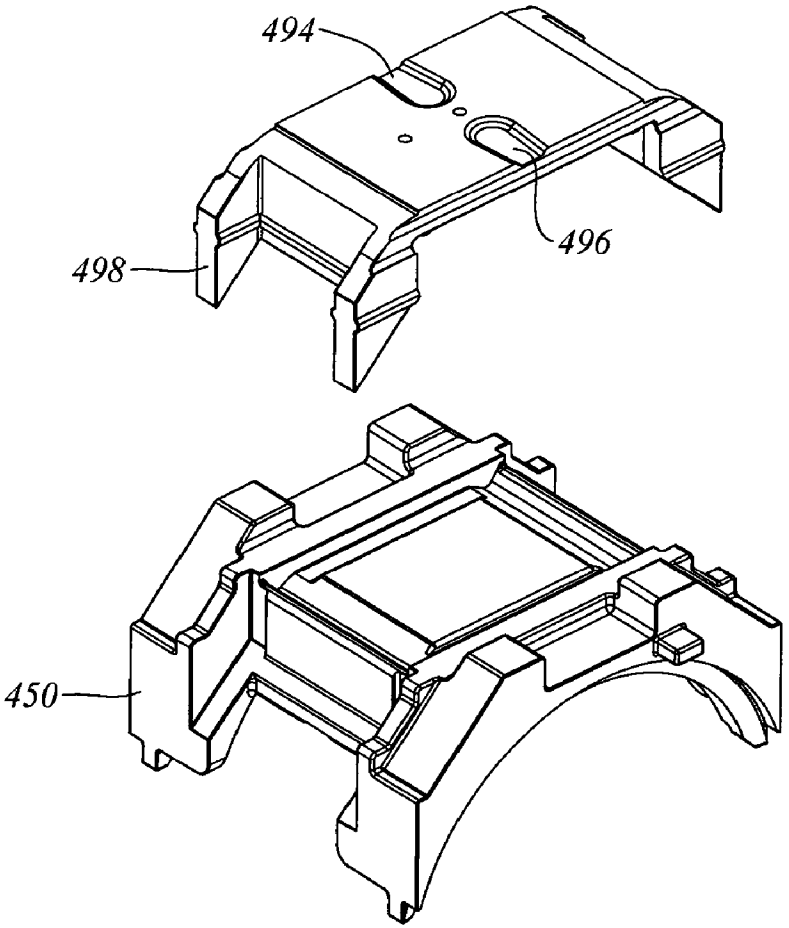
FIG. 9*b* shows an isometric view, from above, of an alternate bearing adapter and pad combination to that of FIG. 8*a* having reliefs on the upper side of the pad.
Figure 9C:
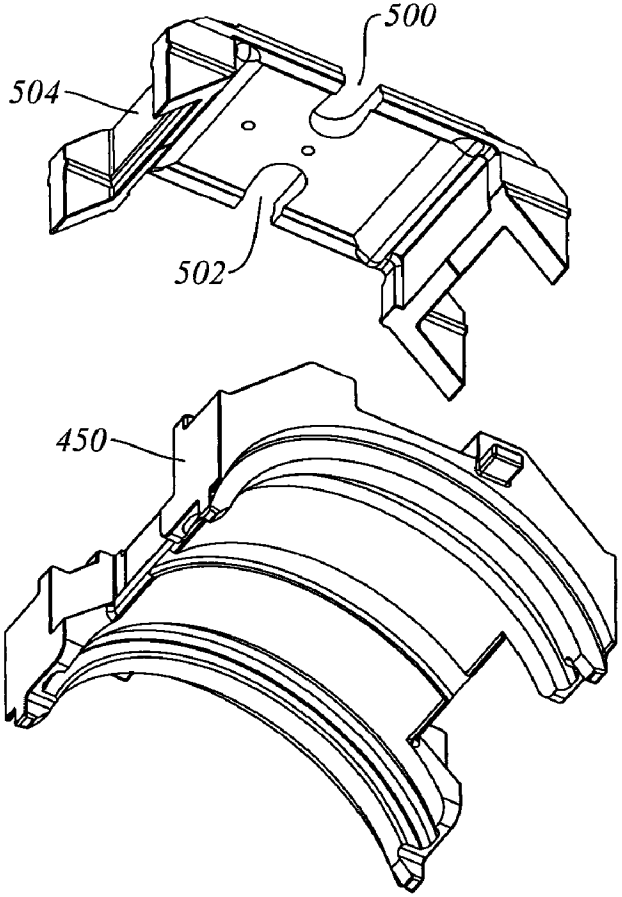
FIG. 9*c* shows a view similar to FIG. 9*a*, but of an alternate pad wherein the pad has reliefs extending fully therethrough.

FIGS. 9*a*-9*c*

In the embodiments of FIGS. 9*a*-9*c*, a bearing adapter, such as bearing adapter 450, may be surmounted by a resilient member having cusp shaped reliefs or rebates formed therein, of similar nature, and shape, to those previously described. Those cusps may be identified as 488, 490, in the underside of resilient member 492 of FIG. 9*a*, or as cusps 494, 496 in the upper surface of resilient member 498 of FIG. 9*b*, or cusps 500, 502 that extend fully through resilient member 504 of FIG. 9*c*. In each case, the cusps may tend to yield a region above the top central portion of the underlying bearing races through which reduced vertical loading is passed from the pedestal roof to the bearing adapter.

FIGS. 10*a*-10*e*

In the embodiments of FIGS. 10*a* to 10*e* bearing adapter 450 may be surmounted by a resilient member 510, 512 or 514, each having an array of longitudinally extending slots be it 516, 518 or 520. Array 516 may extend through the full depth of section, array 518 may be formed in the upper portion, and extend only partially through the section, and array 520 may be formed in the lower portion and extend upwardly only partially though the section. The central region 522, 524 or 526 of each resilient member may tend to have a lower mean vertical stiffness per unit area than the adjacent regions of unslotted material to either side thereof. Consequently, vertical loads may tend to be passed predominantly to either side of the central slotted region. This central slotted region may tend to lie over the top center of the bearing, and over the top center of the races of the bearing.

FIG. 10*f*

Figure 10E:
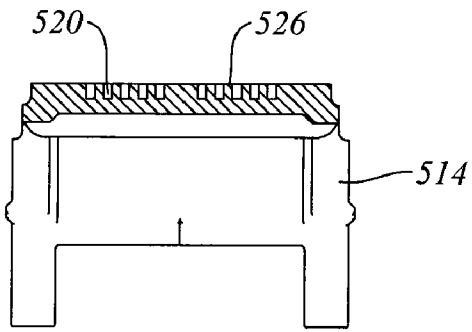
FIG. 10*e* shows a lateral cross-section of an alternate pad to that of FIG. 10*c;*
Figure 10D:
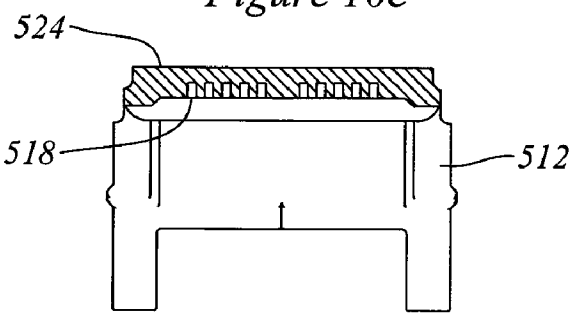
FIG. 10*d* shows a lateral cross-section of an alternate pad to that of FIG. 10*c;*
Figure 10C:
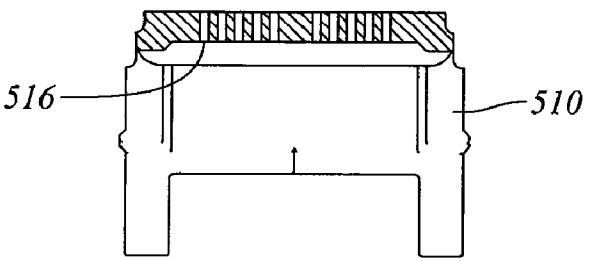
FIG. 10*c* shows a section on the lateral plane of symmetry of the pad of FIG. 10*a;*
Figure 10B:
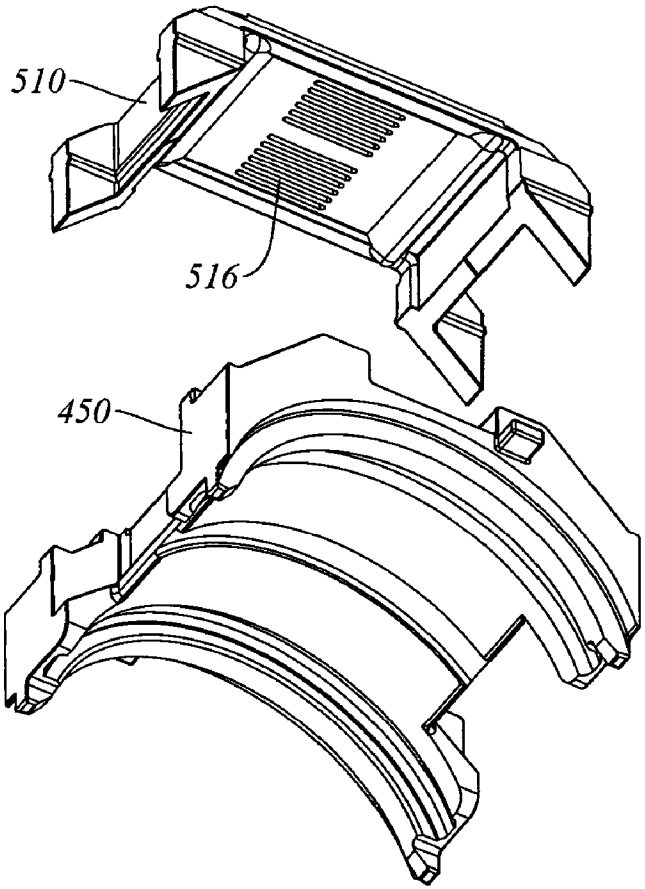
FIG. 10*b* shows an underside isometric view of the bearing adapter and pad combination of FIG. 10*a;*
Figure 10A:
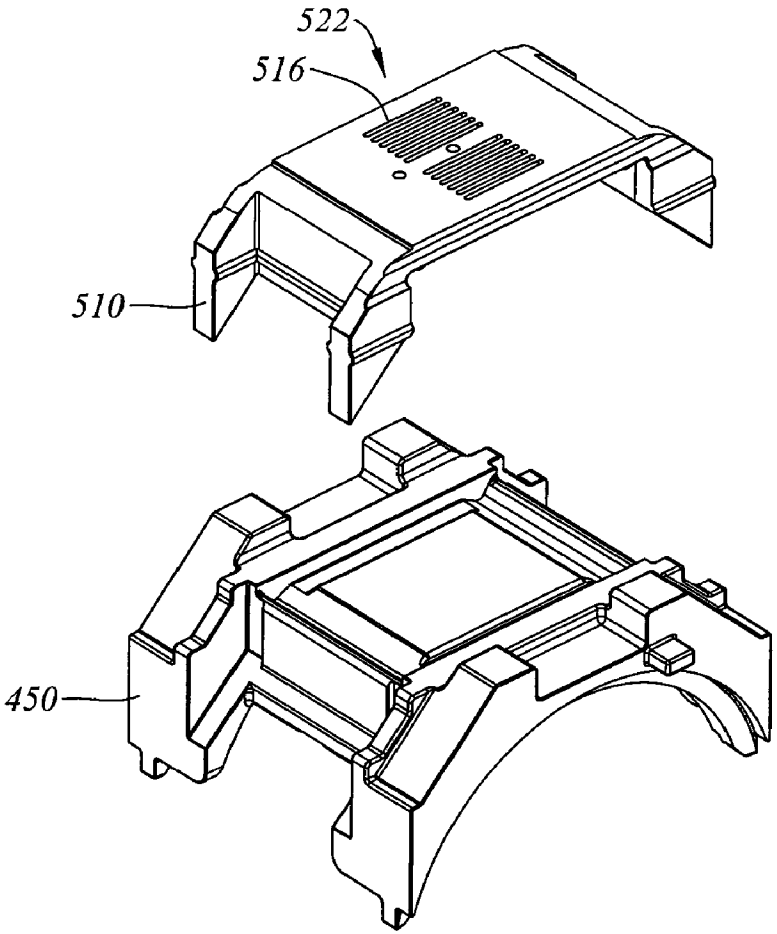
FIG. 10*a* shows an isometric view from above of an alternate bearing adapter and pad combination to that of FIG. 8*a*, having an array of longitudinally extending slots.
Figure 10G:
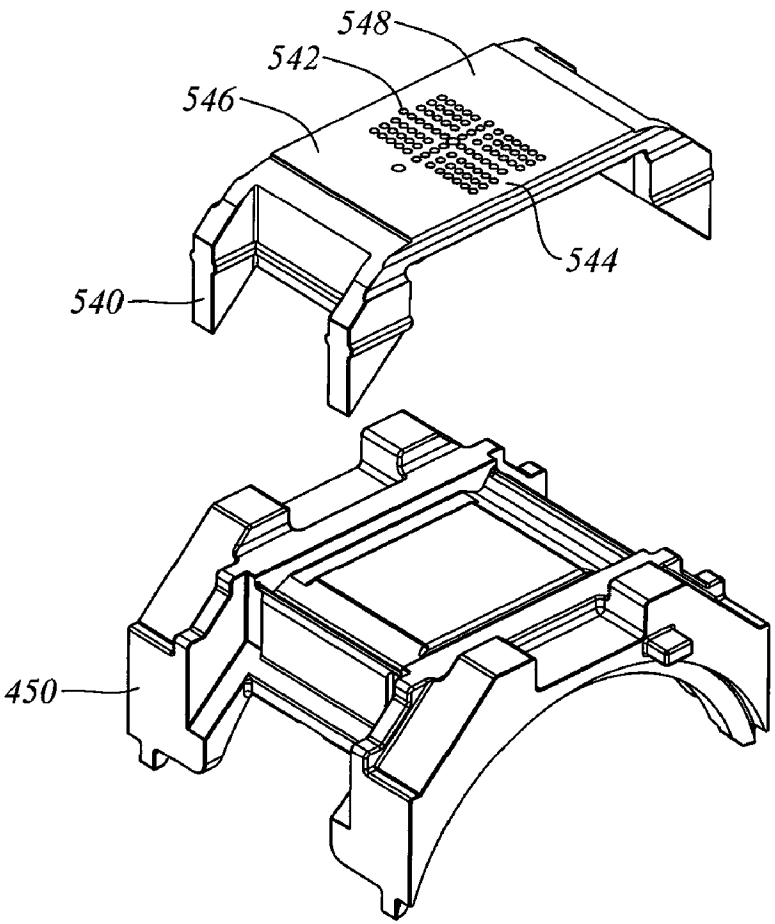
FIG. 10*g* shows an isometric view from above of an alternate bearing adapter and pad combination to that of FIG. 8*a* in which the pad has a perforated medial portion.
Figure 10F:
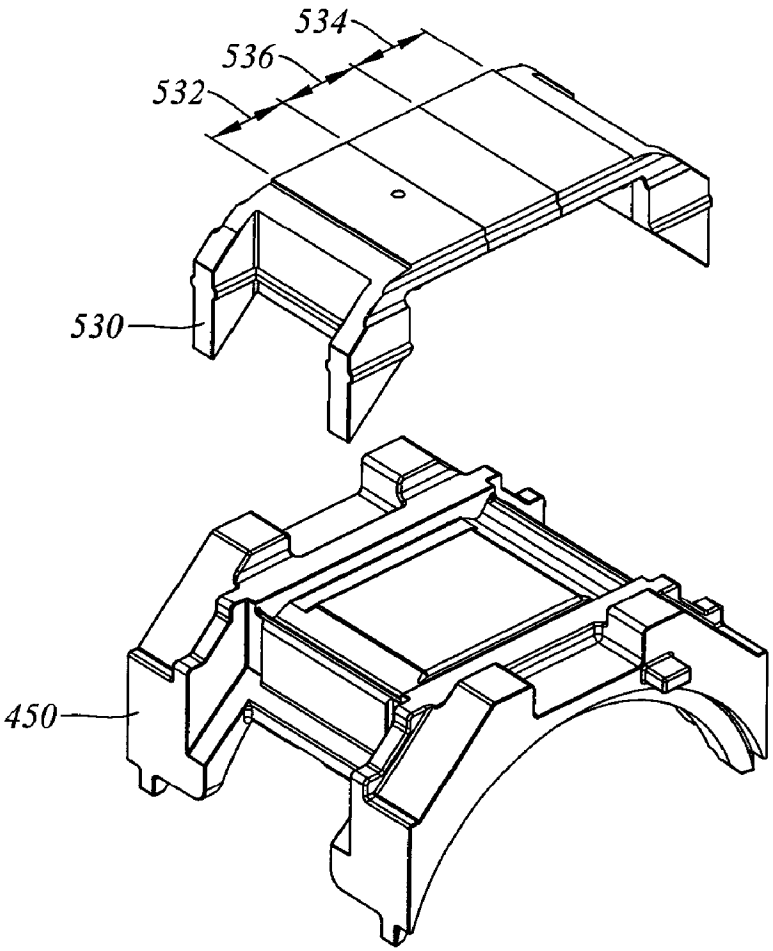
FIG. 10*f* shows an isometric view from above of an alternate pad to that of FIG. 8*a*; having a central portion of a different resiliency than the end portions.

In FIG. 10*f*, bearing adapter 450 is surmounted by a mating resilient member 530 that is substantially the same as resilient member 342 except insofar as it has end regions 532, 534 that are made of a material having a first bulk modulus of elasticity, or a first response to vertical loading, and a central region 536 that has a second bulk modulus of elasticity, or a second response to vertical loading. For example, regions 532 and 534 may be made of a higher density polymeric material than central region 536. Central region 536 may have a lower vertical stiffness per unit area than adjacent regions 532 and 534, such that when squeezed between the pedestal roof and the bearing adapter, as by a vertical load, the force transmitted through regions 532 and 534 may tend to be disproportionately greater on a force per unit area basis than through region 536. Region 536 may have a width corresponding to the width of roughly a single roller of bearing 46.

FIG. 10*g*

In FIG. 10*g*, bearing adapter 450 may be surmounted by a resilient member 540. Resilient member 540 may have an array of bores, or voids, 542 formed therein in a central region 544. Adjacent regions 546 and 548 may lack such bores or voids. The mean vertical stiffness per unit area of central region 544 may be less than the corresponding mean vertical stiffness per unit area of regions 546, 548, such that vertical loading of resilient member, as when loaded by vertical forces imposed by a sideframe pedestal, may tend to be carried preferentially, or disproportionately by the adjacent regions 546 or 548. Voids 542 may extend fully through the thickness of region 544, or may extend only partially therethrough.

Figure 11D:
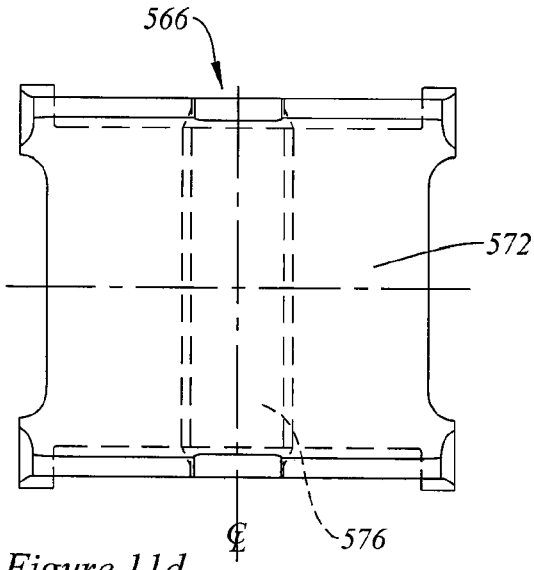
FIG. 11*d* shows a top view of the pedestal seat member of FIG. 11*c;*
Figure 11E:
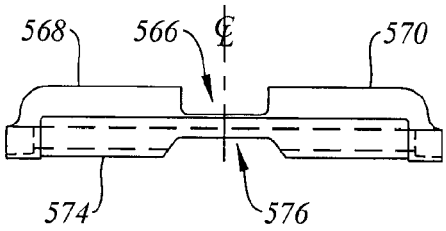
FIG. 11*e* shows a side view of the pedestal seat member of FIG. 11*c;*
Figure 11C:
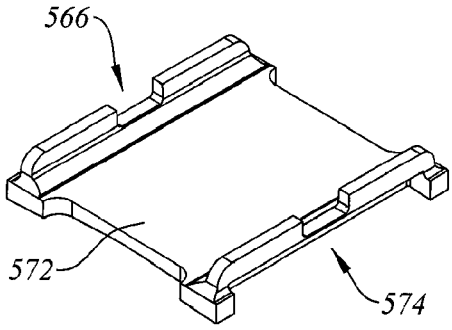
FIG. 11*c* shows an isometric view, from above, of an alternate pedestal seat member to that of FIG. 11*b;*
Figure 11B:
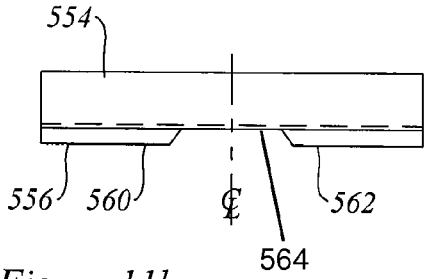
FIG. 11*b* shows a side view of a pedestal seat member for the assembly of FIG. 11*a;*
Figure 11A:
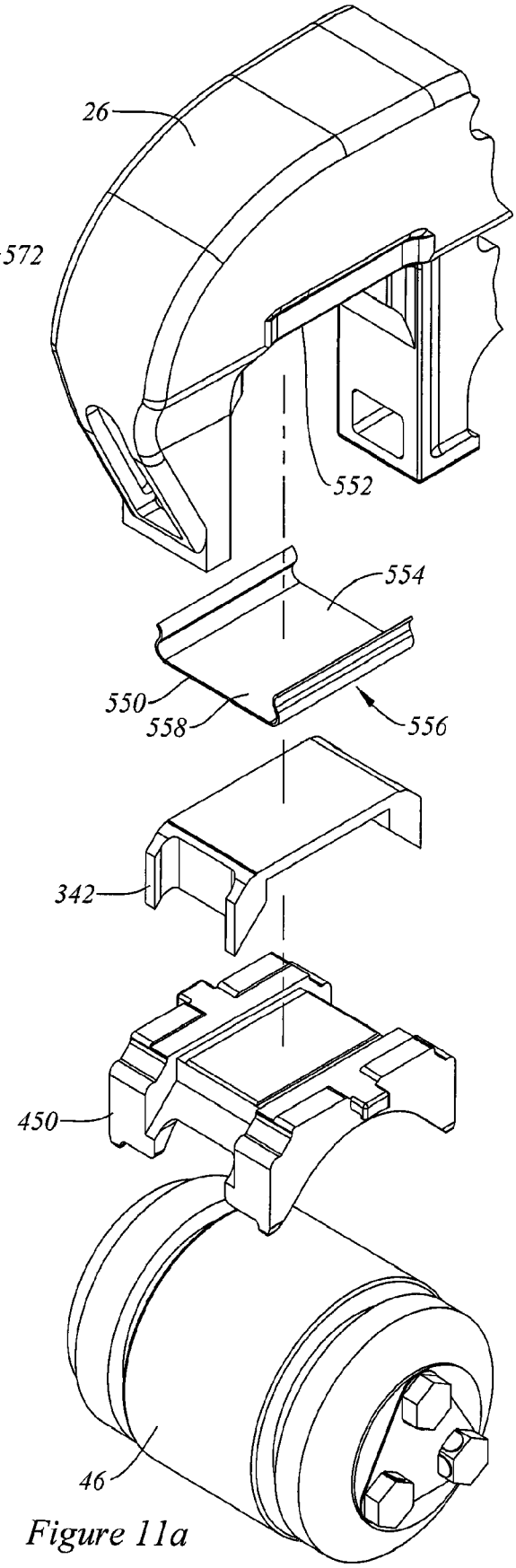
FIG. 11*a* shows an exploded isometric view from above of an alternate bearing adapter, pad and pedestal seat assembly to that of FIG. 8*a;*

FIGS. 11*a* and 11*b*

In FIG. 11*a* an alternate wheelset to sideframe pedestal interface assembly may include bearing adapter 450 mounted to bearing 46. Resilient member 342 may be mounted to bearing adapter 450. Another member 550 may be mounted between resilient member 342 and the pedestal roof 552. Member 550 may be a pedestal seat 554 having a downwardly facing pad engagement interface, indicate generally as 556, and an upwardly facing surface 558 for mating with the pedestal roof. Pedestal seat 550 may have the general form of a Dynaclip pedestal roof liner, including longitudinally extending members for grasping the sideframe, in the nature of sprung, curled up edges that may seat in a spring fit to the sideframe on either side of the pedestal roof. Pad engagement interface 556 of pedestal seat 554 may include a pair of spaced apart, downwardly extending pedestal members or plates, or standoffs, indicated as load transfer members 560, 562. Members 560, 562 stand proud of the downwardly facing intervening portion 564 of pedestal seat 554 by a height (or depth, as it my alternately be termed) that may be as great as, or greater than, the deflection of the underlying resilient member 342 when truck 22 is loaded to some level, be it the full rated capacity of the truck, or some value representing the mean in service loading of the truck plus, for example, one or two standard deviations from that mean loading. The spacing between members 560 and 562 may be greater than the width of one roller of the rollers in the roller bearing, and may be in the range of ¾ to 1¼ inches, and may be centered over the top of bearing 46. Members 560 and 562 could also be formed from a single rectangular plate, having an H-shaped footprint defined therein, similar to the H-shaped footprint described above in the context of bearing adapters and resilient pads.

FIGS. 11*c* to 11*e*

In the alternate embodiment of FIG. 11*c*, a pedestal seat 566 may be used in place of pedestal seat 554. Pedestal seat 566 may have sideframe indexing or engagement features, such as may be in the nature of lugs 568, 570 formed by notching an upturned side flange. These lugs may engage a similar mating lug mounted centrally on the pedestal roof lateral centerline. Pedestal seat 566 may include a central body portion 572, which may be in the nature of a substantially rectangular plate extending between the upturned lugs, and extending under the length of the sideframe pedestal roof for a length that may generally correspond to the length of underlying bearing adapter 450. Vertical loads may be passed from the pedestal roof into resilient member 342 and bearing adapter 450. The downwardly facing resilient pad load transfer interface 574 of pedestal seat 566 may include a laterally extending slot, rebate, relief, or channel 576 formed therein, and centered over the axis of rotation of bearing 46. (Alternatively, an H-shaped land could be defined by forming cusps in seat 566 in the substantially planar horizontal central portion 572, in the manner of the cusps described above.) The depth of the relief, or channel 576 (or cusps, as may be) may be as great as, or greater than the vertical deflection of resilient member 342 when vertical loads are passed from the pedestal seat during operation of truck 22. As noted above, the depth of the relief may be based on the deflection of the resilient pad at the full rated load of the truck, at the mean loading, at the mean loading plus one, two, or three standard deviations, or another design value. In one embodiment the depth may be chosen such that, in most, if not all regimes of operation a gap may be maintained between the top of resilient member 342 and the underside of the central portion of the relief, be it channel 576. This same criterion may apply to one or more embodiments of the other embodiments described herein for establishing a vertical load path discontinuity.

Whether in the context of an embodiment of FIG. 11*a*, FIG. 11*c*, or some other, it may be understood that a similar result may be achieved by forming a pedestal seat roof having a downwardly facing interface for mating directly with, for example, resilient member 243, wherein that downwardly facing interface is the same, or similar to, that of either pedestal seat member 554 or 556, having a pair of spaced apart blocks, in which the pairing of the blocks, (or a single plate formed to have an H-shaped footprint as described), and the spacing may be centered to run laterally over the axis of the bearing, such plate or profile being welded in place, for example.

Figure 12A:
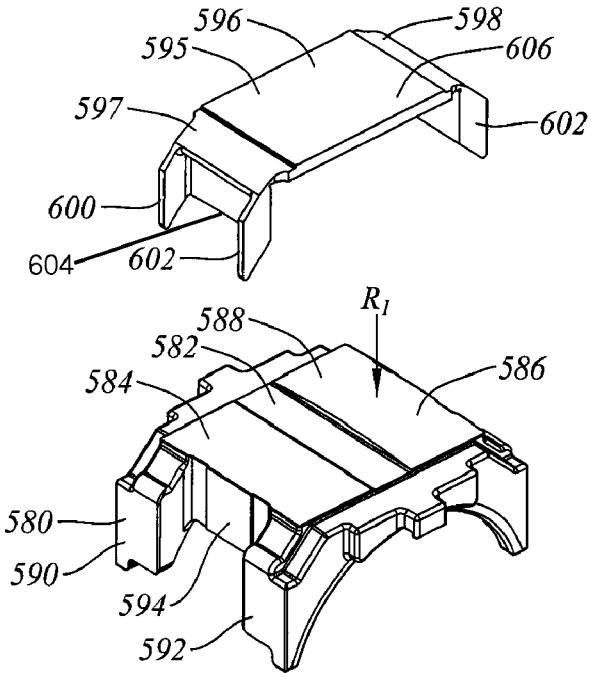
FIG. 12*a* shows an exploded isometric view, from above, of an alternate combination of bearing adapter and pad to that of FIG. 4*a;*
Figure 12B:
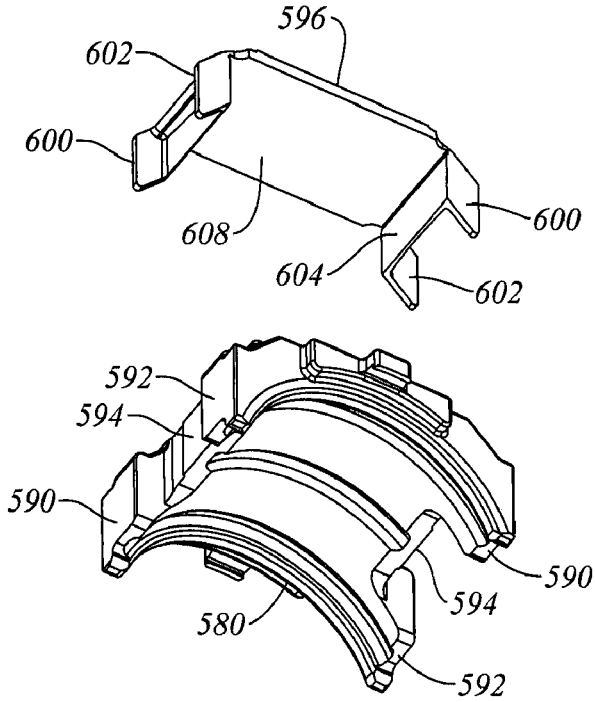
FIG. 12*b* shows an exploded isometric view, from below, of an alternate combination of bearing adapter and pad to that of FIG. 4*a;*
Figure 12C:
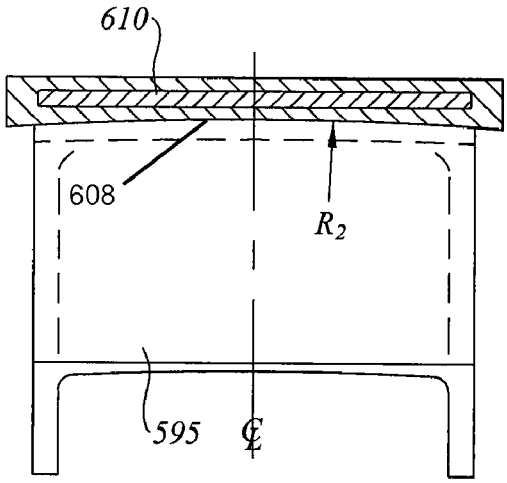
FIG. 12*c* is a section on the central, lateral plane of symmetry of the pad of FIG. 12*a;*

FIGS. 12*a* to 12*c*

In the embodiment of FIGS. 12*a*-12*c*, there is a bearing adapter 580 which may have an underside that may have a bearing engagement interface similar to that of bearing adapter 450. The top side of bearing adapter 450 may include a central region 582, and two adjacent side regions 584 and 586. Central region 582 may be about an inch wide, and may have an upwardly facing surface 588 that is substantially planar, and that may tend to lie in a horizontal plane when installed in an at-rest position of a railroad car on level tangent track. Side regions 584 and 586 may have upwardly facing surfaces that stand proud of surface 588. Side regions 584 and 586 may be formed on a radius, $R_1$. That radius, $R_1$, may be (nominally, or actually) a 60 inch crown radius, with the axis of the crown being perpendicular to the axis of rotation of bearing 46. Bearing adapter 580 has corner abutments 590, and arches 592, and end walls 594. The end walls and the adjacent corner abutments 590 at each end form a channel shaped opening such that, when installed, the thrust lugs of the pedestal jaws lie in the channel shaped opening.

A resilient member 595 seats on top of bearing adapter 580. Resilient member 595 has a central portion 596 that runs between end portions 597 and 598. End portions 594 and 598 may include downwardly depending legs 600 and 602 that may seat inside the corner abutments, and a depending skirt 604 that may seat against end wall 594. The upper surface 606 of resilient member 594 may be flat, and may matingly engage the pedestal seat or pedestal roof as may be. The lower surface of central portion 596 may seat upon the upwardly facing surfaces of regions 584 and 586. Inasmuch as those surfaces are proud of the surface of central region 582, vertical loads may tend to compress those regions of resilient member 594 that lie over regions 584 and 586 than that region of resilient member 594 that lies over central portion 586. In one embodiment the underside 608 of resilient member 594 may be formed on a radius $R_2$ that may be the same as, or at least nominally similar to radius $R_1$, such that the part may matingly engage, and, when undeflected, may leave a gap between the underside of resilient member 594 and the upwardly facing surface of central region 582.

In one embodiment, resilient member 594 may include an internal member 610 such as may be a plate. Internal member 610 may be made of a steel or predominantly iron based alloy, and may be bonded or cast inside resilient member 594. Internal member may be substantially planar, and may, in one embodiment, extend throughout the majority of the central portion of resilient member 594. In another embodiment, there may be two internal members 610, one being located to seat predominantly, or entirely, over each of regions 584 and 586, and being spaced apart from each other.

Figure 12E:
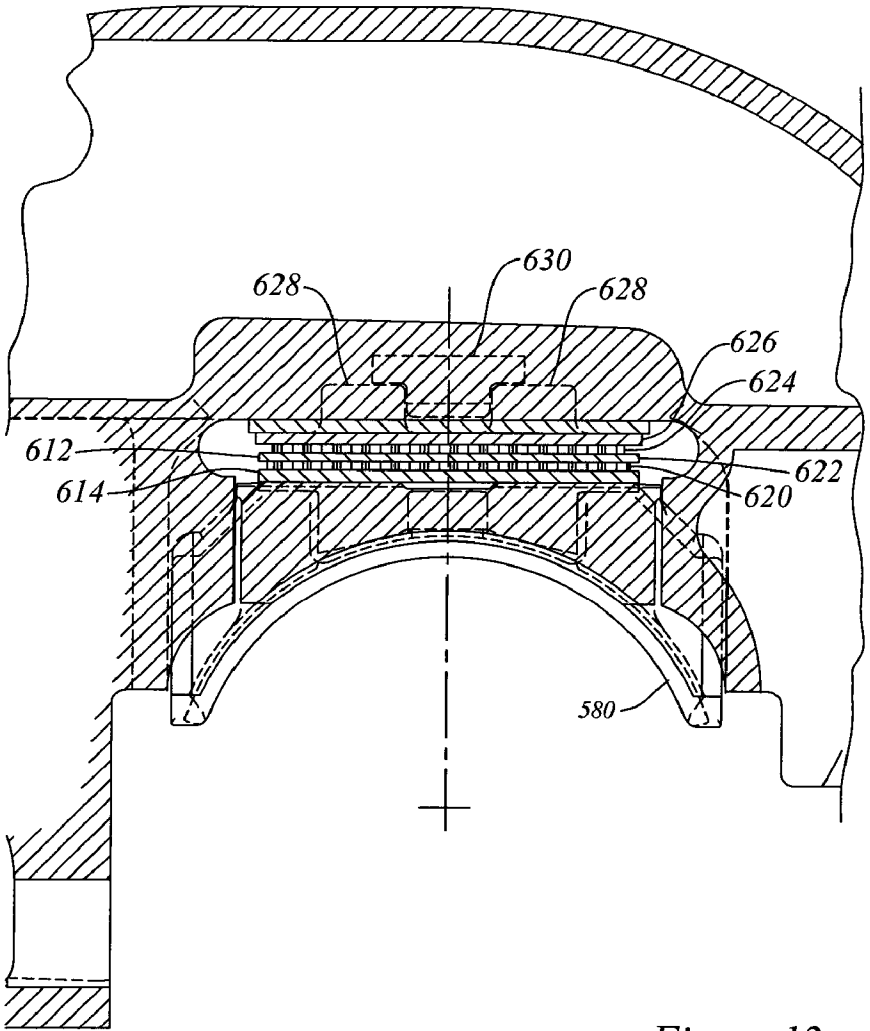
FIG. 12*e* shows a section of the bearing adapter and pad combination of FIG. 12*d* on the longitudinal plane of symmetry thereof.
Figure 12D:
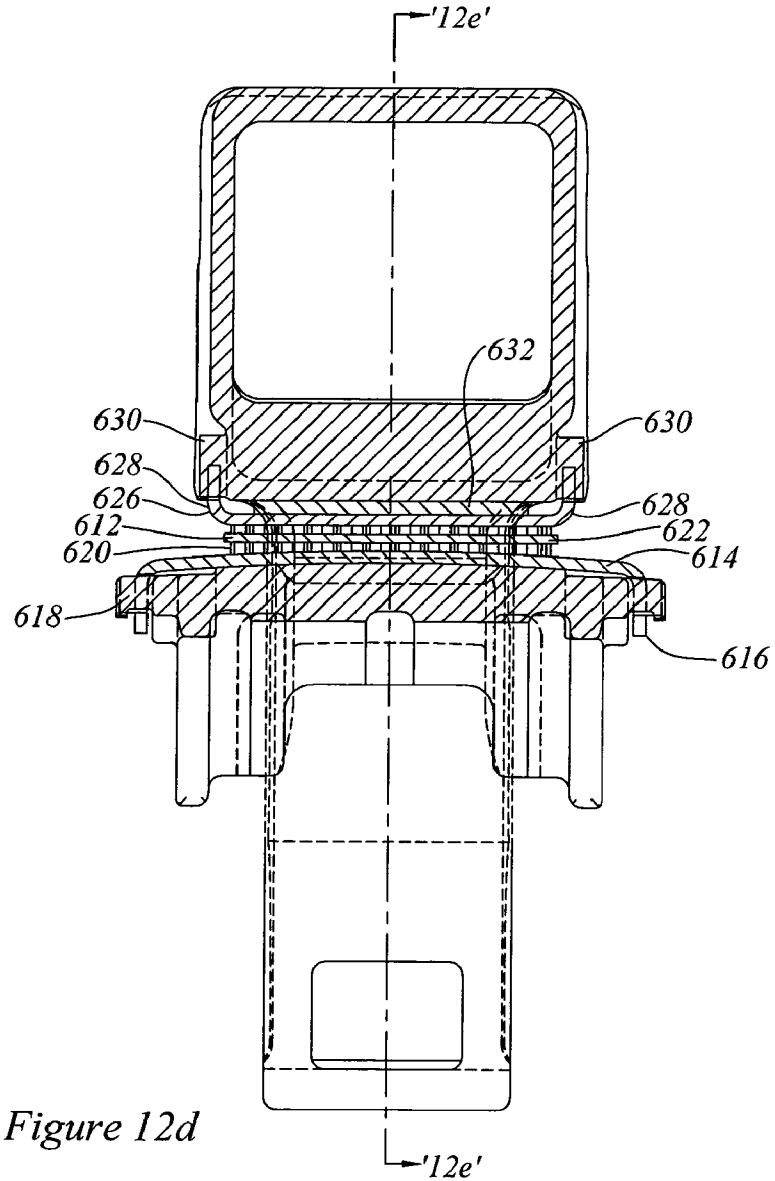
FIG. 12*d* shows a section of an alternate bearing adapter and pad combination to that of FIG. 12*a* at the lateral plane of symmetry thereof, as installed in a pedestal seat.

FIGS. 12*d* and 12*e*

FIGS. 12*d* and 12*e* show another embodiment of bearing adapter and resilient pad combination. The bearing adapter may once again be bearing adapter 580, as shown in FIGS. 12*a* to 12*c*, and described above. The resilient member may be a laminated resilient assembly 612 that may include a bottom skin, or plate 614 formed to seat upon regions 584 and 586 of bearing adapter 580. Plate 614 may be made of a metal, such as steel. Plate 614 may leave a gap over central portion 582 of bearing adapter 580. Plate 614 may have a bottom surface formed to conform to the upwardly facing curved surfaces of regions 584 and 586. Plate 614 may also have indexing or locating features, such as may be in the nature of laterally extending locating lugs, or fingers, or claws, or tabs, with downwardly curved toes or tangs or tabs 616 such as may bracket a laterally extending lug 618 of bearing adapter 580.

A first layer of resilient material, indicated as 620, may be bonded to the upper surface of plate 614. An intermediate plate 622 may be bonded atop layer 620. A second layer 624 of resilient material may be bonded to intermediate plate 622. A top plate, or pedestal liner 626 may be mounted above layer 624, and may have tangs 628 for location about lugs 630 mounted on sideframe 26 on either side of the pedestal roof 632.

Figure 13B:
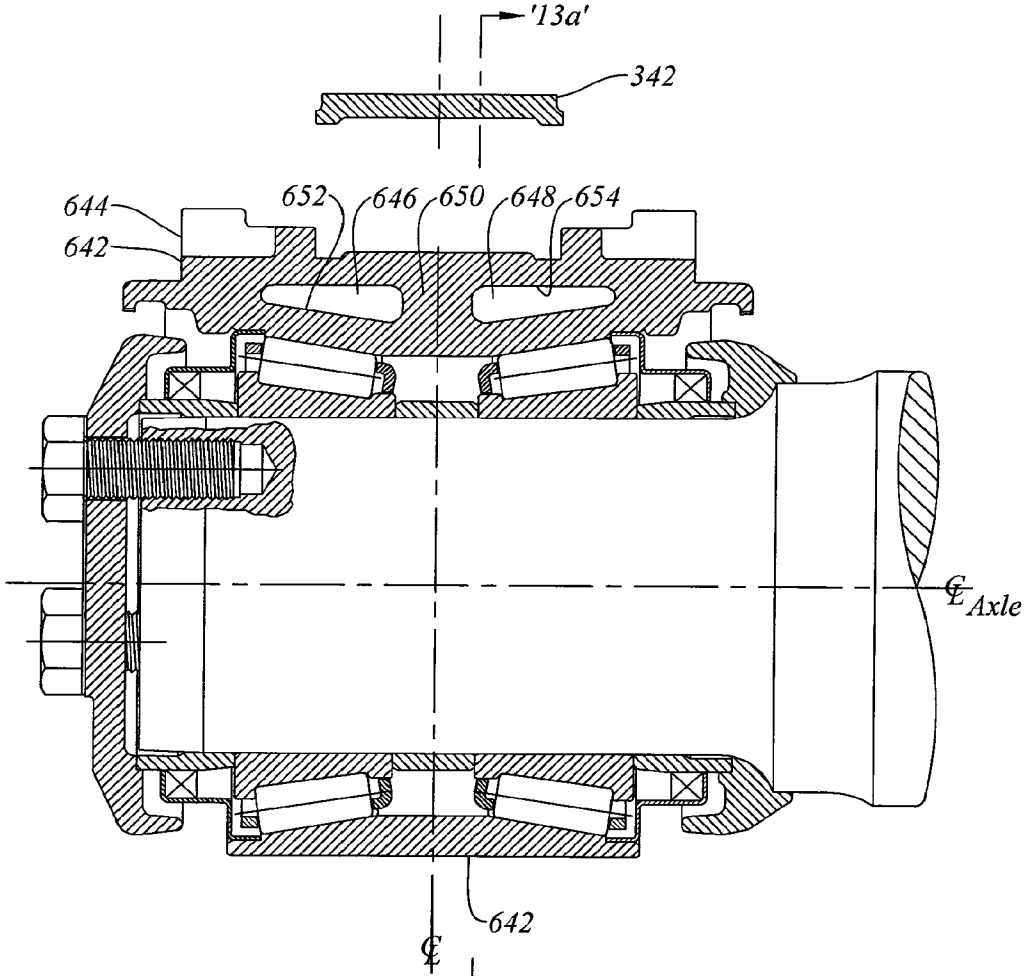
FIG. 13*b* shows a cross-section on a longitudinal plane of symmetry of an integrated bearing, bearing adapter pad.
Figure 13A:
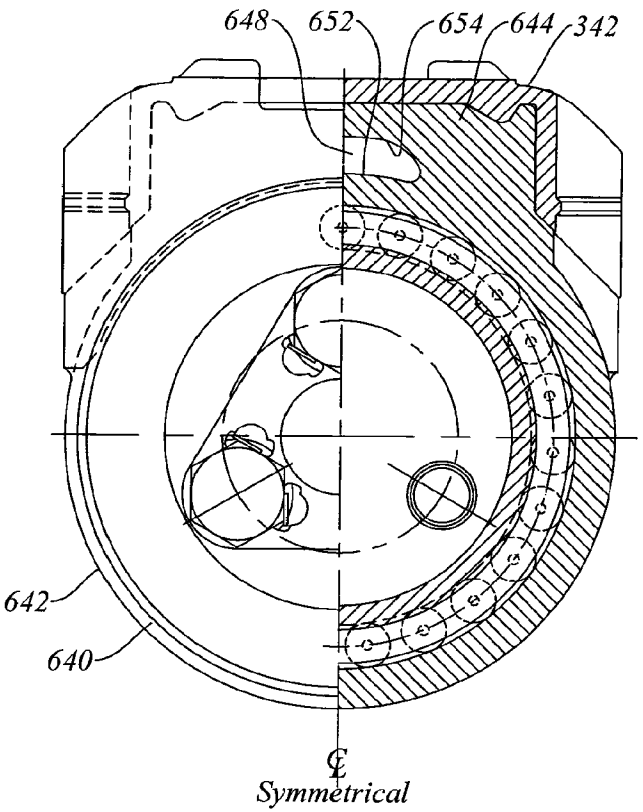
FIG. 13*a* is a half end view, half section view of the assembly of FIG. 13*b*, as viewed looking along the long axis of the bearing, the half section being a view on section '13*a*-13*a*' of FIG. 13*b*.

FIGS. 13*a* and 13*b*

FIGS. 13*a* and 13*b* show an alternate embodiment in which a bearing 640 has a casing 642 having a bearing adapter integrally formed thereon. Bearing 640 is, in most respects, the same as, or similar to bearing 46 in terms of general construction, race location, number and size of rollers, and so on. In addition to having an upper portion 644 that may have substantially the same upper surface bed features as bearing adapter 44, and so being able to mate with resilient member 342, upper portion 644 may include internal cavities 646, 648 formed to lie over the apex of the bearing races in the top dead center position. Cavities 646 and 648 may be centered over the axis of rotation of the roller bearing races of bearing 640. A web 650 may run circumferentially between cavities 646 and 648, centrally between, rather than over, the bearing races. In the circumferential direction, cavities 646 and 648 may have an extent corresponding to, or perhaps somewhat greater than the size of one roller. Similarly, in the axial direction, cavities 646 and 648 may have a length as great as or greater than the length of one roller. The shape of cavities 646 and 648 is such as to leave a lower arch, or ring section 652 over the uppermost roller position, and an arched roof portion 654, which may tend to distribute vertical loading to either side of the uppermost roller position. The juncture between arched roof portion 654 and ring section 652 may be on a smooth radius.

Friction Surfaces

In the various truck embodiments described herein, there is a friction damping interface between the bolster and the sideframes. Either the sideframe columns or the damper (or both) may have a low or controlled friction bearing surface, that may include a hardened wear plate, that may be replaceable if worn or broken, or that may include a consumable coating or shoe, or pad. That bearing face of the motion calming, friction damping element may be obtained by treating the surface to yield desired coefficients of static and dynamic friction whether by application of a surface coating, and insert, a pad, a brake shoe or brake lining, or other treatment. Shoes and linings may be obtained from clutch and brake lining suppliers, of which one is Railway Friction Products. Such a shoe or lining may have a polymer based or composite matrix, loaded with a mixture of metal or other particles of materials to yield a specified friction performance. Shoes and linings may be replaceable, as indicated, for example in U.S. Pat. No. 6,374,749 of Duncan, or U.S. Pat. No. 6,701,850 of McCabe et al, (those documents being incorporated by reference herein).

That friction surface may, when employed in combination with the opposed bearing surface, have a co-efficient of static friction, $\mu_s$, and a co-efficient of dynamic or kinetic friction, $\mu_k$. The coefficients may vary with environmental conditions. For the purposes of this description, the friction coefficients will be taken as being considered on a dry day condition at 70 F. In one embodiment, when dry, the coefficients of friction may be in the range of 0.15 to 0.45, may be in the narrower range of 0.20 to 0.35, and, in one embodiment, may be about 0.30. In one embodiment that coating, or pad, may, when employed in combination with the opposed bearing surface of the sideframe column, result in coefficients of static and dynamic friction at the friction interface that are within 20%, or, more narrowly, within 10% of each other. In another embodiment, the coefficients of static and dynamic friction are substantially equal. It may be that an elastomeric material may be employed as described in U.S. patent Re 31784 or Re 31,988, both of Wiebe, (those documents being incorporated herein by reference).

Sloped Wedge Surface

Where damper wedges are employed, a generally low friction, or controlled friction pad or coating may also be employed on the sloped surface of the damper that engages the wear plate (if such is employed) of the bolster pocket where there may be a partially sliding, partially rocking dynamic interaction. A controlled friction interface between the slope face of the wedge and the inclined face of the bolster pocket, in which the combination of wear plate and friction member may tend to yield coefficients of friction of known properties, may be used. A polymeric surface, or pad having these friction properties may be used, as may a suitable clutch or brake lining material. In some embodiments those coefficients may be the same, or nearly the same, and may have little or no tendency to exhibit stick-slip behaviour, or may have a reduced stick-slip tendency as compared to cast iron on steel. Further, the use of brake linings, or inserts of cast materials having known friction properties may tend to permit the properties to be controlled within a narrower, more predictable and more repeatable range such as may yield a reasonable level of consistency in operation. The coating, or pad, or lining, may be a polymeric element, or an element having a polymeric or composite matrix loaded with suitable friction materials. It may be obtained from a brake or clutch lining manufacturer, or the like. One such firm that may be able to provide such friction materials is Railway Friction Products of 13601 Laurinburg Maxton Ai, Maxton N.C.; another may be Quadrant EPP USA Inc., of 2120 Fairmont Ave., Reading Pa. In one embodiment, the material may be the same as that employed by the Standard Car Truck Company in the "Barber Twin Guard" (t.m.) damper wedge with polymer covers. In one embodiment the material may be such that a coating, or pad, may, when employed with the opposed bearing surface of the sideframe column, result in coefficients of static and dynamic friction at the friction interface that are within 20%, or more narrowly, within 10% of each other. In another embodiment, the coefficients of static and dynamic friction are substantially equal. The co-efficient of dynamic friction may be in the range of 0.15 to 0.30, and in one embodiment may be about 0.20.

A damper may be provided with a friction specific treatment, whether by coating, pad or lining, on both the vertical friction face and the slope face. The coefficients of friction on the slope face need not be the same as on the friction face, although they may be. In one embodiment it may be that the coefficients of static and dynamic friction on the friction face may be about 0.3, and may be about equal to each other, while the coefficients of static and dynamic friction on the slope face may be about 0.2, and may be about equal to each other. In either case, whether on the vertical bearing face against the sideframe column, or on the sloped face in the bolster pocket, the present inventors consider it to be advantageous to avoid surface pairings that may tend to lead to galling, and stick-slip behaviour.

Combinations and Permutations

The present description recites many examples of dampers and bearing adapter arrangements. Not all of the features need be present at one time, and various optional combinations can be made. As such, the features of the embodiments of several of the various FIGS. may be mixed and matched, without departing from the spirit or scope of the invention. For the purpose of avoiding redundant description, it will be understood that the various damper configurations can be used with spring groups of a 2×4, 3×3, 3:2:3, 2:3:2, 3×5 or other arrangement. Similarly, several variations of bearing to pedestal seat adapter interface arrangements have been described and illustrated. There are a large number of possible combinations and permutations of damper arrangements and bearing adapter arrangements. In that light, it may be understood that the various features can be combined, without further multiplication of drawings and description.

The various embodiments described herein may employ self-steering apparatus in combination with dampers that may tend to exhibit little or no stick-slip behaviour. They may employ a "Pennsy" pad, or other elastomeric pad arrangement, for providing self-steering. Further still, the various embodiments described herein may employ a four cornered damper wedge arrangement, which may include bearing surfaces of a non-stick-slip nature, in combination with a self steering apparatus.

Various embodiments of the invention have been described in detail. Since changes in and or additions to the above-described best mode may be made without departing from the nature, spirit or scope of the invention, the invention is not to be limited to those details but only by the appended claims.

What is claimed is:

1. An elastomeric pad for seating between a bearing adapter and a pedestal seat roof of a railroad car truck, the bearing adapter having arches for seating on a casing of a bearing of an axle of a wheelset, and first and second ends having respective pairs of corner abutments for seating in opposition to pedestal seat jaw thrust lugs, and a pair of first and second crown members formed on an upper surface thereof, the crown members sharing a common axis of curvature, the axis of curvature being perpendicular to the axle, wherein said elastomeric pad comprises a main portion for overlying said crown members and a first end portion, the first end portion including a depending member formed to seat between the corner abutments of the bearing adapter, the main portion having a face for engagement with the upper surface of the bearing adapter, said face being formed on a 60 inch radius of curvature to match said crown members; and said elastomeric pad has the form of a "Pennsy" pad that has been hollowed out on the underside to conform to the crowned members of the bearing adapter.

2. The elastomeric pad of claim 1 wherein said elastomeric pad has a second end portion, the second end portion having a form to seat between the corner abutments of the other end of the bearing adapter.

3. The elastomeric pad of claim 1 wherein said elastomeric pad has a metal plate mounted thereto, said plate extending in a layer throughout the majority of the main portion thereof.

4. The elastomeric pad of claim 1 wherein said elastomeric pad has a pair of substantially planar plates mounted thereto, each plate being located, in use, above one of the crown members of the bearing adapter, leaving a central gap therebetween.

5. A rail road car truck having a bolster mounted cross-wise between a pair of sideframes, the sideframes having pedestal seats mounted over bearing adapters, the bearing adapters being seated on casings of bearings mounted to wheelset axles, wherein said truck has an elastomeric pad according to claim 1 inserted between each bearing adapter and its pedestal seat pair.

6. The rail road car truck of claim 5 wherein said truck is a Barber S2HD truck and having said elastomeric pads installed therein.

7. The rail road car truck of claim 5 wherein said bolster has respective first and second ends, and said truck has a set of four individually sprung dampers mounted at each of said first and second ends of said bolster.

8. An elastomeric pad for seating between a bearing adapter and a pedestal seat roof of a railroad car truck, the bearing adapter having arches for seating on a casing of a bearing of an axle of a wheelset, and first and second ends having respective pairs of corner abutments for seating in opposition to pedestal seat jaw thrust lugs, and a pair of first and second crown members formed on an upper surface thereof, the crown members sharing a common axis of curvature, the axis of curvature being perpendicular to the axle, wherein said elastomeric pad comprises a main portion for overlying said crown members and a first end portion, the first end portion including a depending member formed to seat between the corner abutments of the bearing adapter, the main portion having a face for engagement with the upper surface of the bearing adapter, said face being formed on a 60 inch radius of curvature to match said crown members; and said elastomeric pad has the form of a laminate, said laminate includes a first metal bottom plate shaped to conform to one of the crowned members of the bearing adapter.

9. The elastomeric pad of claim 8 wherein said elastomeric pad includes a second bottom plate formed to conform to one of the crowned members of the bearing adapter, there being a gap between said first and second bottom plates.

10. The elastomeric pad of claim 8 wherein said laminate includes a second metal plate separated from said first bottom plate by an intervening elastomeric layer.

11. The elastomeric pad of claim 10 wherein a further elastomeric layer overlays said second metal plate.

12. The elastomeric pad of claim 11 in combination with a pedestal seat liner for mounting above said further elastomeric layer.

13. A rail road car truck having a bolster mounted cross-wise between a pair of sideframes, the sideframes having pedestal seats mounted over bearing adapters, the bearing adapters being seated on casings of bearings mounted to wheelset axles, wherein said truck has a pad according to claim 8 inserted between each bearing adapter and its pedestal seat pair.

14. The rail road car truck of claim 13 wherein said truck is a Barber S2HD truck and having said elastomeric pads installed therein.

15. The rail road car truck of claim 13 wherein said bolster has respective first and second ends, and said truck has a set of four individually sprung dampers mounted at each of said first and second ends of said bolster.

16. The combination of an elastomeric pad for seating between a bearing adapter and a pedestal seat roof of a railroad car truck, and a bearing adapter; said bearing adapter having arches for engaging ends of a bearing casing of a bearing of a wheelset axle of the railroad car truck; said bearing adapter having first and second ends having respective pairs of corner abutments for seating in opposition to pedestal seat jaw thrust lugs, and an underside for seating atop the bearing casing, the underside of the bearing adapter being relieved at a location above top dead center of a bearing race of the bearing; said bearing adapter having a pair of first and second crown members formed on an upper surface thereof, the crown members sharing a common axis of curvature, the axis of curvature being perpendicular to an axle of the truck; and said elastomeric pad has a main portion for overlying said crown members and a first end portion, the first end portion including a depending member formed to seat between the corner abutments of the bearing adapter, the main portion having a face for engagement with the upper surface of the bearing adapter, said face being formed on a 60 inch radius of curvature to match said crown members of said bearing adapter.

17. The combination of claim 16 wherein said elastomeric pad has a second end portion, the second end portion having a form to seat between the corner abutments of the other end of the bearing adapter.

18. The combination of claim 16 wherein said elastomeric pad has a metal plate mounted thereto, said plate extending in a layer throughout the majority of the main portion thereof.

19. The elastomeric pad of claim 16 wherein said elastomeric pad has a pair of substantially planar plates mounted thereto, each plate being located, in use, above one of the crown members of the bearing adapter, leaving a central gap therebetween.

20. The combination of claim 16 wherein said elastomeric pad has the form of a "Pennsy" pad that has been hollowed out on the underside to conform to the crowned members of the bearing adapter.

21. A rail road car truck that includes the combination of claim 16 and a bolster mounted cross-wise between a pair of sideframes; the sideframes have pedestal seats mounted over bearing adapters, said bearing adapters being seated on casings of bearings mounted to wheelset axles; and said elastomeric pad is inserted between each said bearing adapter and its pedestal seat pair.

22. The rail road car truck of claim 21 wherein said truck is a Barber S2HD truck and having said elastomeric pads installed therein.

23. The rail road car truck of claim 21 wherein said bolster has respective first and second ends, and said truck has a set of four individually sprung dampers mounted at each of said first and second ends of said bolster.

24. The combination of a pad and a bearing adapter, said pad being a pad for insertion between said bearing adapter and a pedestal seat of a rail road car truck, said pad having a main portion and a pair of end portions, said end portions being formed to seat between respective pairs of corner abutments of said bearing adapter adjacent to respective ends of said bearing adapter, the main portion of the pad being formed to overlie the bearing adapter, the main portion including a central region and first and second end regions, said first and second end regions having proportionately greater stiffness for resisting vertical loading than said central region; and said bearing adapter having arches for engaging the ends of a bearing casing of a wheelset of the rail road car truck, and an underside for seating atop the bearing casing, the underside of the bearing adapter being relieved at a location above top dead center of a bearing race of a bearing.

25. The combination of claim 24 wherein said central region of said pad includes one of (a) a relief;

(b) internal voids (c) slots; and (d) an array of perforations.

26. The combination of claim 24 wherein said pad has the form of one of (a) a "Pennsy" pad with a weakened central region; and (b) an "LC" pad with a weakened central region.

27. A rail road car truck having a bolster mounted cross-wise between a pair of sideframes, the rail road car truck having the combination of said pad and said bearing adapter of claim 24, the sideframes having pedestal seats mounted over bearing adapters, the bearing adapters being seated on casings of bearings mounted to wheelset axles, wherein said truck has said pad inserted between each said bearing adapter and its pedestal seat pair.

28. The rail road car truck of claim 27 wherein said truck is a Barber S2HD truck having said pads installed therein.

29. The rail road car truck of claim 27 wherein said bolster has respective first and second ends, and said truck has a set of four individually sprung dampers mounted at each of said first and second ends of said bolster.

30. The combination of a bearing adapter and a pair of elastomeric pads for insertion between the bearing adapter and a pedestal seat roof of a sideframe pedestal of a sideframe of a rail road car truck, the pads each having a main portion and an end portion, each said end portion being formed to seat between a respective pair of corner abutments of one end of the bearing adapter adjacent to a respective end of the bearing adapter, the main portion of the pads being formed to overlie a crowned portion of an upper surface of the bearing adapter, the upper surface of the bearing adapter being longer than the sum of the length of the main portions of said pair of elastomeric pads, whereby, when installed as a pair, a gap remains between said main portions, said gap being located centrally between ends of the bearing adapter.

31. The combination of claim 30 wherein said pair of elastomeric pads, when taken together have the form of one of (a) a "Pennsy" pad with a central section removed; and (b) an "LC" pad with a central section removed.

32. The combination of claim 30, wherein the bearing adapter has arches for engaging the ends of a bearing casing, and an underside for seating atop the bearing casing, the underside of the bearing adapter being relieved at a location above top dead center of a bearing race of a bearing.

33. A rail road car truck including the combination of claim 30, the truck having a bolster mounted cross-wise between a pair of sideframes, the sideframes having pedestal seats, each pedestal seat being mounted over one said bearing adapter, each said bearing adapter being seated on a casing of a bearing mounted to a wheelset axle, and said truck has one pair of said pads inserted between each said bearing adapter and its corresponding pedestal seat, vertical loads from said pedestal seats being carried into said bearing adapters through said pair of pads.

34. The rail road car truck of claim 33 wherein said truck is a Barber S2HD truck having said pair of elastomeric pads installed therein.

35. The rail road car truck of claim 33 wherein said bolster has respective first and second ends, and said truck has a set of four individually sprung dampers mounted at each of said first and second ends of said bolster.

* * * * *